US010458158B2

(12) United States Patent
Takagi et al.

(10) Patent No.: US 10,458,158 B2
(45) Date of Patent: Oct. 29, 2019

(54) VEHICLE DOOR LOCK APPARATUS

(71) Applicant: ANSEI CORPORATION, Obu (JP)

(72) Inventors: Masaharu Takagi, Nagoya (JP); Satoshi Yamaji, Nagoya (JP)

(73) Assignee: ANSEI CORPORATION, Obu (JP)

( * ) Notice: Subject to any disclaimer, the term of this patent is extended or adjusted under 35 U.S.C. 154(b) by 254 days.

(21) Appl. No.: 15/698,888

(22) Filed: Sep. 8, 2017

(65) Prior Publication Data

US 2018/0080262 A1 Mar. 22, 2018

(30) Foreign Application Priority Data

Sep. 21, 2016 (JP) ..... 2016-183897

(51) Int. Cl.
*E05B 79/08* (2014.01)
*E05B 17/00* (2006.01)
(Continued)

(52) U.S. Cl.
CPC ..... *E05B 79/08* (2013.01); *E05B 17/00* (2013.01); *E05B 79/10* (2013.01); *E05B 79/16* (2013.01);
(Continued)

(58) Field of Classification Search
CPC ..... Y10T 292/1047; Y10T 292/108; Y10T 70/5889; Y10T 292/1048; Y10T 292/1059;
(Continued)

(56) References Cited

U.S. PATENT DOCUMENTS 5,802,894 A * 9/1998 Jahrsetz ..... E05B 77/48 292/144
6,416,088 B1 * 7/2002 Graute ..... E05B 81/14 292/201
(Continued)

FOREIGN PATENT DOCUMENTS

GB 2396656 A 6/2004
JP H0617960 Y2 5/1994
(Continued)

OTHER PUBLICATIONS

Unpublished U.S. Appl. No. 15/456,770.
Unpublished U.S. Appl. No. 15/653,645.
Unpublished U.S. Appl. No. 15/653,700.

*Primary Examiner* — Mark A Williams
(74) *Attorney, Agent, or Firm* — J-Tek Law PLLC; Jeffrey D. Tekanic; Scott T. Wakeman

(57) ABSTRACT

In a vehicle door lock apparatus, when disposed in an unlocking position, a second lever enables a fork to be displaced to an unlatched position and, in a locking position, it disables the fork from being displaced to the unlatched position. Third levers displace the second lever from the locking position to the unlocking position in response to an unlocking operation being performed on a lock operator and displace the second lever from the unlocking position to the locking position in response to a locking operation being performed on the lock operator. In an unblocking position, a fourth lever linked to the fork separates from the second lever. In a blocking position, the fourth lever contacts the second lever and blocks it from being displaced to the locking position. A fifth lever is linked with the fourth lever, detects the position of the fork, and disconnects or connects a switch.

18 Claims, 17 Drawing Sheets

(51) Int. Cl.

| | |
|---|---|
| ***E05B 79/10*** | (2014.01) |
| ***E05B 79/16*** | (2014.01) |
| ***E05B 83/36*** | (2014.01) |
| ***E05B 85/02*** | (2014.01) |
| ***E05B 85/24*** | (2014.01) |
| ***E05B 85/26*** | (2014.01) |
| *E05B 79/22* | (2014.01) |

(52) U.S. Cl.
CPC ..... *E05B 83/36* (2013.01); *E05B 85/02* (2013.01); *E05B 85/243* (2013.01); *E05B 85/26* (2013.01); *E05B 79/22* (2013.01); *E05Y 2900/531* (2013.01)

(58) Field of Classification Search
CPC ..... Y10T 292/09; Y10T 292/102; Y10T 292/1078; E05B 81/14; E05B 81/64; Y10S 292/23
See application file for complete search history.

(56) References Cited

U.S. PATENT DOCUMENTS

| | | | | |
|---|---|---|---|---|
| 6,419,286 | B1 * | 7/2002 | Szablewski | E05B 77/24 292/216 |
| 2003/0218340 | A1 * | 11/2003 | Coleman | E05B 77/06 292/169.11 |
| 2005/0140149 | A1 | 6/2005 | Umino | |
| 2005/0218661 | A1 * | 10/2005 | Brose | E05B 81/06 292/216 |
| 2006/0006671 | A1 * | 1/2006 | Noel | E05B 77/26 292/216 |
| 2006/0028029 | A1 * | 2/2006 | Spurr | E05B 81/20 292/216 |
| 2008/0203737 | A1 * | 8/2008 | Tomaszewski | E05B 77/26 292/216 |
| 2010/0327609 | A1 * | 12/2010 | Akizuki | E05B 81/06 292/85 |
| 2012/0068479 | A1 * | 3/2012 | Bendel | E05B 81/20 292/200 |
| 2013/0049379 | A1 * | 2/2013 | Yokota | E05B 81/20 292/129 |
| 2015/0048632 | A1 * | 2/2015 | Menke | E05B 81/06 292/336.3 |
| 2015/0084352 | A1 * | 3/2015 | Barmscheidt | E05B 81/15 292/201 |
| 2015/0259952 | A1 * | 9/2015 | Barmscheidt | E05B 77/265 292/200 |
| 2015/0267441 | A1 * | 9/2015 | Fuchs | E05B 81/68 292/200 |
| 2016/0017645 | A1 * | 1/2016 | Tomaszewski | E05B 77/26 292/240 |
| 2018/0016820 | A1 | 1/2018 | Takagi et al. | |
| 2018/0023325 | A1 | 1/2018 | Takagi et al. | |
| 2018/0023327 | A1 | 1/2018 | Takagi et al. | |
| 2018/0073282 | A1 | 3/2018 | Takagi et al. | |
| 2018/0148956 | A1 | 5/2018 | Takagi et al. | |

FOREIGN PATENT DOCUMENTS

| | | | |
|---|---|---|---|
| JP | 2002129806 | A | 5/2002 |
| JP | 4163490 | A | 6/2004 |
| JP | 2005188130 | A | 7/2005 |
| JP | 2012180702 | A | 9/2012 |
| JP | 2013117115 | A | 6/2013 |
| JP | 2014015717 | A | 1/2014 |
| JP | 5930273 | B2 | 6/2016 |

* cited by examiner

VEHICLE DOOR LOCK APPARATUS

CROSS-REFERENCE

This application claims the priority benefit of Japanese Patent Application No. 2016-183897 filed on Sep. 21, 2016, the entire contents of which are incorporated by reference as if fully set forth herein.

TECHNICAL FIELD

The present invention relates to a vehicle door lock apparatus.

BACKGROUND ART

Japanese Patent No. 4163490 and its UK counterpart GB 2396656 (Patent Literature 1) disclose a known vehicle door lock apparatus that includes a housing, a fork (latch plate), and a pawl (locking plate).

The housing includes a body (latch unit comprising a plastics body) and an actuator housing (actuator unit comprising a plastics housing). The body is fixed to a door that is openable and closable with respect to a vehicle frame (side wall). The actuator housing is affixed to (mounted on) the body. An entry opening (slot), into which a striker fixed to the vehicle frame can enter, is formed in the body. The fork (latch plate) is pivotably provided in the body. The fork is displaceable to a latched position, where the fork retains the striker in the entry opening, and to an unlatched position, where the fork allows the striker to separate from the entry opening. The pawl (locking plate) is pivotably provided in the body. The pawl fixes or releases the fork.

This known vehicle door lock apparatus includes a first sub-lever, a second sub-lever, a locking/unlocking lever, a knob lever, a linkage lever (straightly movable rack lever), and a detecting lever. The first sub-lever, the second sub-lever, the locking/unlocking lever, and the detecting lever are provided in the body. The knob lever and the linkage lever are provided in the actuator housing.

The first and second sub-levers are displaced in response to an opening operation being performed on a door handle, come into contact with an open lever that is fixed to the pawl (locking plate) so as to integrally pivot therewith, and are capable of causing the pawl (locking plate) to release the fork.

The locking/unlocking lever is capable of being displaced to a locked position, where the locking/unlocking lever retains the first and second sub-levers in a lock position where the first and second sub-levers are unable to come into contact with the open lever, and to an unlocked position, where the locking/unlocking lever does not retain the first and second sub-levers in the lock position. In the unlocked position, the locking/unlocking lever enables (allows) displacement of the fork located in the latched position to the unlatched position. In the locked position, the locking/unlocking lever disables displacement of the fork located in the latched position to the unlatched position.

The knob lever is coupled to a locking/unlocking door knob. The linkage lever (straightly movable rack lever) is disposed between the knob lever and the locking/unlocking lever. The knob lever pivots in response to an unlocking operation being performed on the locking/unlocking door knob to pull down the linkage lever and displaces the locking/unlocking lever from the locking position to the unlocking position. The knob lever pushes up the linkage lever in response to a locking operation being performed on the locking/unlocking knob and displaces the locking/unlocking lever from the unlocking position to the locking position.

An arm portion, a stopper portion, and a detecting projection are formed in the detecting lever. The arm portion is guided in a cam groove of the fork, whereby the detecting lever is linked (interlocked) with the fork and is displaceable from an unblocking position corresponding to the latched position to a blocking position corresponding to the unlatched position and vice versa. In the unblocking position, the detecting lever separates from the locking/unlocking lever. In the blocking position, the detecting lever contacts and stops, via the stopper portion, the locking/unlocking lever located in the unlocking position and inhibits (prevents, blocks) the locking/unlocking lever from being displaced to the locking position. Further, the detecting lever detects whether the fork is located in the latched position or in the unlatched position and the detecting projection disconnects or connects a switch.

In this known vehicle door lock apparatus, when the fork is located in the unlatched position, the locking/unlocking lever located in the unlocking position contacts and is stopped by the detecting lever that has been displaced to the blocking position so that the locking/unlocking lever is inhibited (blocked) from being displaced to the locking position. In this state, even if a user (vehicle occupant) attempts to perform a locking operation in which the knob lever would normally pivot, pivoting of the knob lever is prevented (blocked) by the linkage lever, the locking/unlocking lever, and the detecting lever. As a result, the locking operation attempted by the user is prevented.

However, in this known vehicle door lock apparatus, since the pivoting of the knob lever is prevented (blocked) by three components (i.e. the linkage lever, the locking/unlocking lever, and the detecting lever), rattling among the components tends to accumulate and it is difficult to improve blocking rigidity (stiffness, resistance) with respect to the knob lever.

Furthermore, the detecting lever of this known vehicle door lock apparatus must perform the functions of (i) linking with the fork, (ii) contacting and stopping (blocking) the locking/unlocking lever, (iii) detecting the position of the fork and (iv) disconnecting or connecting the switch. Therefore, the fork, the locking/unlocking lever, the detecting lever, and the switch have to be disposed in positions close to one another, whereby it becomes difficult to design a vehicle door lock apparatus so that the thickness of the vehicle door lock apparatus in the vehicle inward-outward direction can be reduced.

SUMMARY OF THE INVENTION

In view of these circumstances, it is an object of the present teachings to provide an improved vehicle door lock apparatus that can improve blocking rigidity (stiffness, resistance) with respect to a third lever when the fork is located in the unlatched position and/or can achieve a reduction in thickness in the vehicle inward-outward direction.

A vehicle door lock apparatus of the present invention may include, e.g.:

a housing fixed to a door that is openable and closable with respect to a vehicle frame, the housing having an entry opening, into which a striker fixed to the vehicle frame can enter;

a fork pivotably provided in the housing and that is displaceable to a latched position, where the fork retains the striker in the entry opening, and to an unlatched position, where the fork allows the striker to separate from the entry opening;

a pawl pivotably provided in the housing, the pawl fixing or releasing the fork;

a first lever provided in the housing and that is displaceable in response to an opening operation being performed on a door handle to act on the pawl and is capable of causing the pawl to release the fork;

a second lever provided in the housing and that is displaceable to a locking position, where the second lever retains the first lever in a locked position where the first lever is unable to act on the pawl, and to an unlocking position where the second lever does not retain the first lever in the locked position, wherein, in the unlocking position, the second lever enables (allows) displacement of the fork located in the latched position to the unlatched position and, in the locking position, the second lever disables (prevents, blocks) displacement of the fork located in the latched position to the unlatched position;

a third lever provided in the housing, the third lever displacing the second lever from the locking position to the unlocking position in response to an unlocking operation being performed on a lock operator and displacing the second lever from the unlocking position to the locking position in response to a locking operation being performed on the lock operator;

a fourth lever provided in the housing, the fourth lever being linked (interlocked) with the fork to be displaceable to an unblocking position corresponding to the latched position and to a blocking position corresponding to the unlatched position, wherein, in the unblocking position, the fourth lever is separated (spaced apart) from the second lever, and, in the blocking position, the fourth lever contacts and stops (blocks) the second lever located in the unlocking position and thereby inhibits (prevents, blocks) the second lever from being displaced to the locking position; and a fifth lever provided in the housing, the fifth lever being linked (interlocked) with the fourth lever, detecting whether the fork is located in the latched position or the unlatched position, and disconnecting or connecting a switch.

Other aspects and advantages of the present invention will be apparent from the embodiments disclosed in the following description and the attached drawings, the illustrations exemplified in the drawings, and the general concept or gist of the invention disclosed in the entire description and drawings.

DETAILED DESCRIPTION OF PREFERRED EMBODIMENTS

Embodiment of the present teachings will be explained below with reference to the drawings.

First Embodiment

Figure 1:
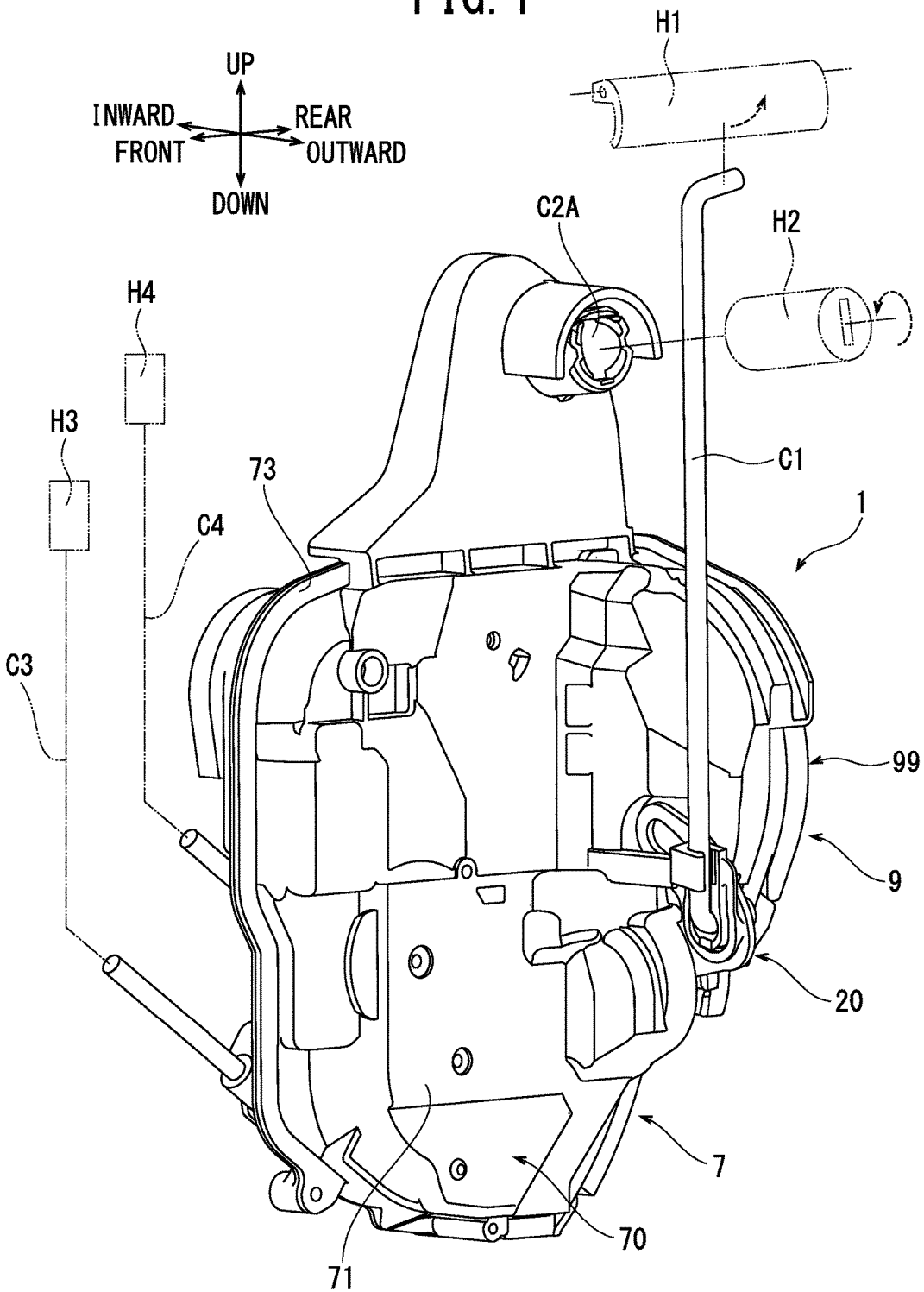
FIG. 1 is a perspective view of a vehicle door lock apparatus according to a first embodiment of the present teachings.
Figure 2:
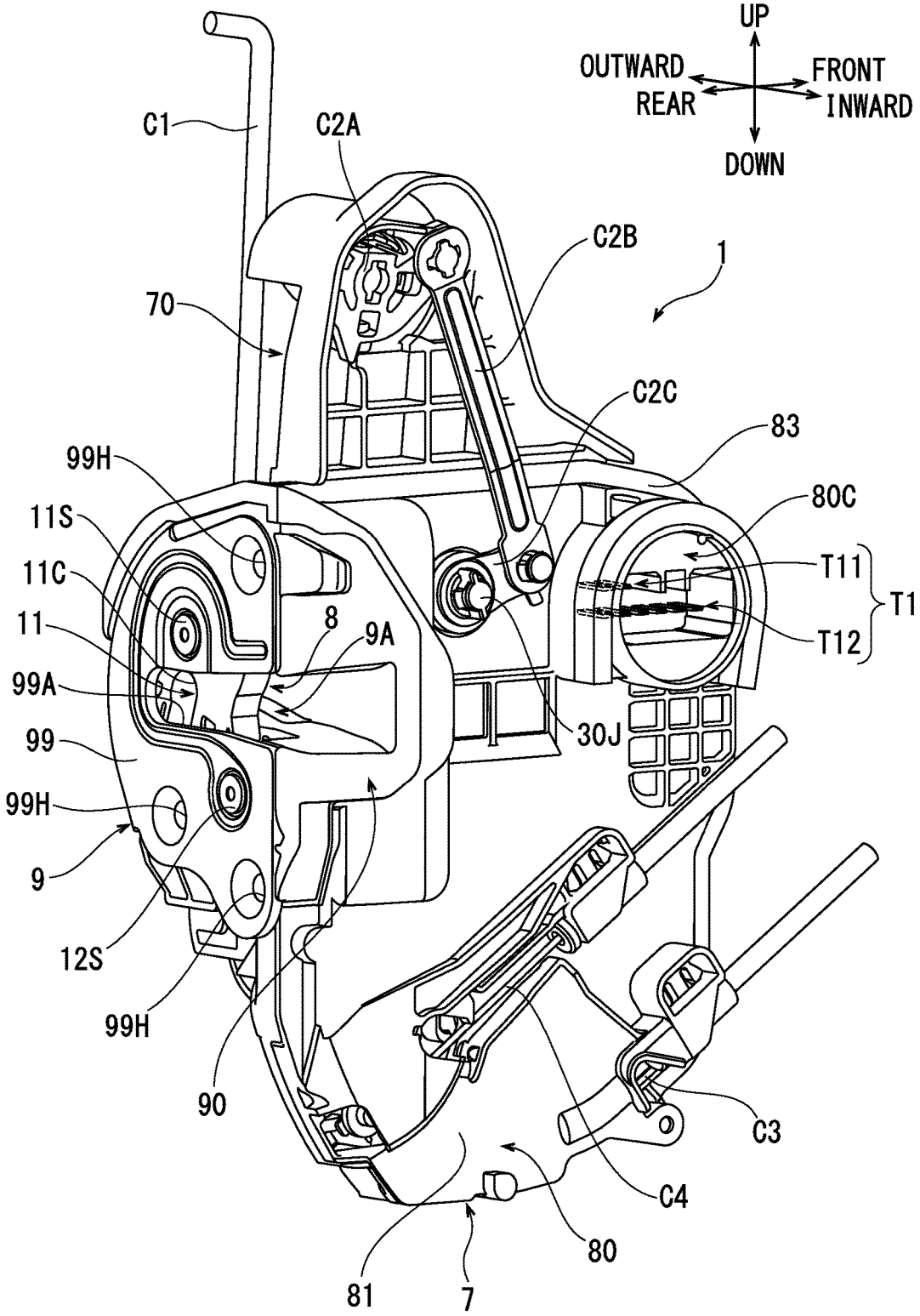
FIG. 2 is a perspective view of the vehicle door lock apparatus.

FIGS. 1 and 2 show a vehicle door lock apparatus 1 (hereinafter sometimes simply referred to as "door lock apparatus 1") according to a representative, non-limiting first embodiment of the present teachings. As shown, e.g., in FIGS. 20 and 21, the door lock apparatus 1 is configured to be affixed (attached) to a door (A1, A2) that is openable and closable relative to a vehicle frame (chassis) of a vehicle, such as an automobile, a bus, a commercial vehicle, a truck, etc. By retaining (latching or holding) a striker that is affixed to the vehicle frame, the door lock apparatus 1 is capable of retaining (holding) the door closed with respect to the vehicle frame.

In FIGS. 1 and 2, the door lock apparatus 1 is configured to be disposed on the inside at the rear end of the door provided on the left side surface of the vehicle frame. It is noted that, when another door lock apparatus 1 is affixed to the rear end of the door provided on the right side surface of the vehicle frame, the two door lock apparatuses 1 will be disposed in a mirror image state. In addition or in the alternative, the door lock apparatus 1 according to the present teachings can be provided in (on) a tail gate, or another portion of the vehicle.

The front-rear direction and the up-down direction shown in FIGS. 1 and 2 are based on the front-rear (longitudinal) direction and the up-down (vertical or height) direction of the vehicle. The vehicle inward-outward (lateral) direction shown in FIGS. 1 and 2 is based on a person sitting in the cabin of the vehicle. The left surface side of the vehicle is set as the vehicle exterior and the opposite side is set as the vehicle interior. The front-rear direction, the up-down direction, and the vehicle inward-outward direction shown in FIG. 3 and the reference directions shown in the subsequent Figures correspond to the reference directions shown in FIGS. 1 and 2.

As shown in FIG. 1, an exterior door handle H1 and a key cylinder H2 are disposed on the outer surface of a not-shown door, to which the door lock apparatus 1 is affixed. An interior door lock knob H3 and an interior door handle H4 are disposed on the inner surface of the door that is exposed to (faces) the cabin of the vehicle. The exterior door handle H1 and the interior door handle H4 are representative, non-limiting examples of a "door handle" according to the present teachings. The interior door lock knob H3 and the key cylinder H2 are representative, non-limiting examples of a "lock operator" according to the present teachings.

Figure 20:
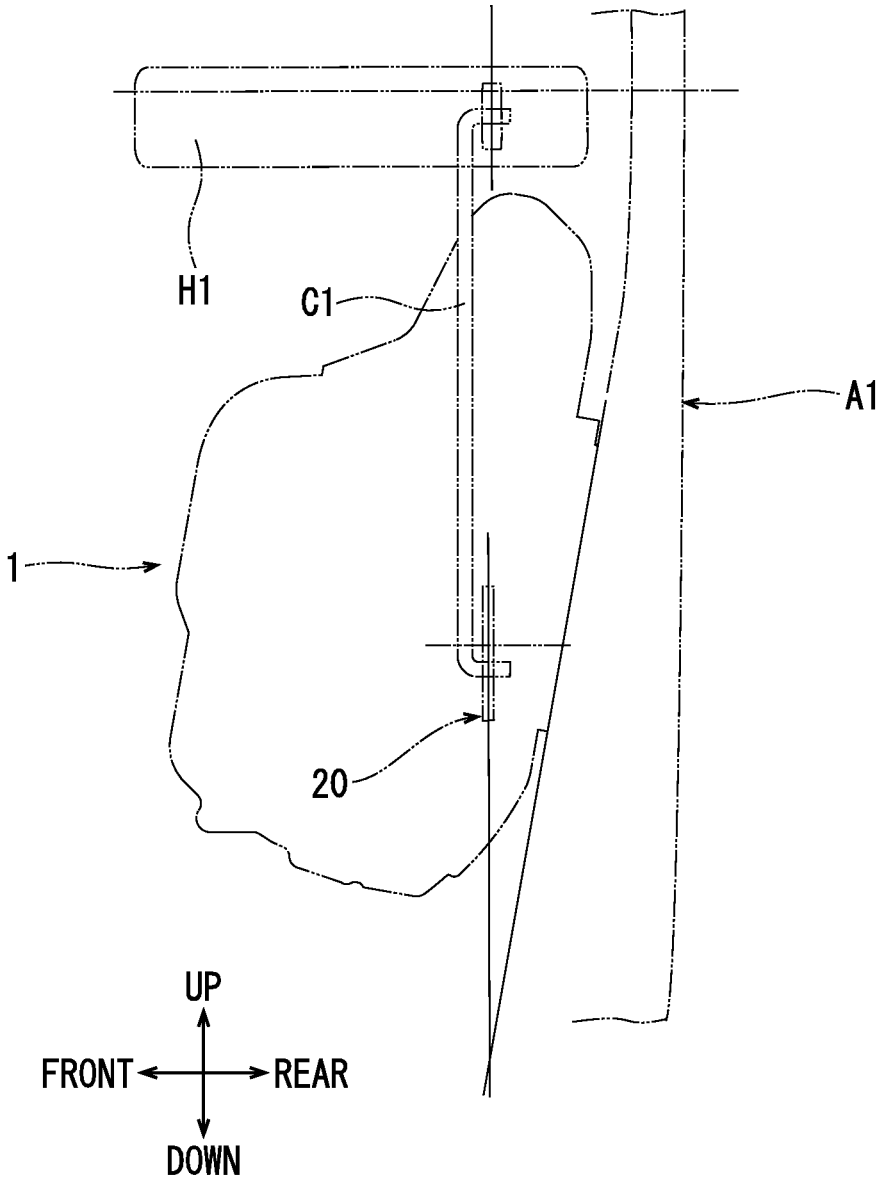
FIG. 20 is a schematic view for explaining the positional relationship of a door handle relative to a transmission rod in an embodiment in which the vehicle door lock apparatus of the first embodiment is mounted on, for example, a front door.
Figure 21:
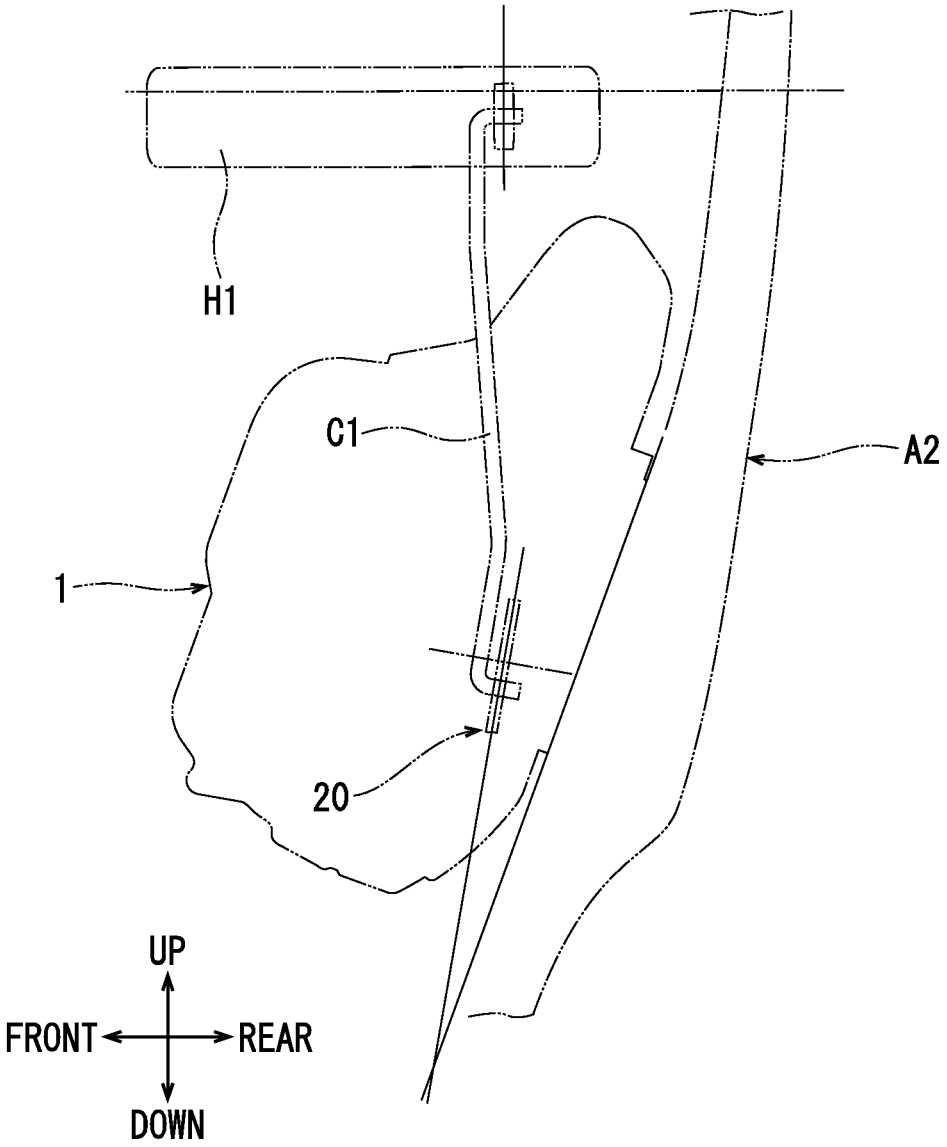
FIG. 21 is a schematic view for explaining the positional relationship of the door handle relative to the transmission rod in an embodiment in which the vehicle door lock apparatus of the first embodiment is mounted on, for example, a rear door.

An upper end portion of a transmission rod C1 is operably coupled to the exterior door handle H1. The door lock apparatus 1 is disposed downward of the exterior door handle H1 on the inside of the door (A1, A2), as shown in FIGS. 20 and 21. A lower end portion of the transmission rod C1 is operably coupled to an outside ("O/S") open lever 20 of the door lock apparatus 1.

The key cylinder H2 is retained so as to be rotatable integrally with a key-cylinder retainer C2A, which is rotatably (turnably) provided at (in) the upper end portion of the door lock apparatus 1. As shown in FIG. 2, the upper end of a link rod C2B is operably coupled to the key-cylinder retainer C2A. The lower end of the link rod C2B is connected to an outside ("O/S") lock lever 30, which will explained below with reference to FIG. 6, etc., via a link lever C2C.

As shown in FIG. 1, a first end of a transmission cable C3 is connected to the interior door lock knob H3. A first end of a transmission cable C4 is connected to the interior door handle H4. As shown in FIG. 2, a second end of the transmission cable C3 is drawn into the door lock apparatus 1 and connected to an inside ("I/S") lock lever 35, which will be explained below with reference to FIG. 6, etc. A second end of the transmission cable C4 is drawn into the door lock apparatus 1 and connected to an inside ("I/S") open lever 25, which will also be explained below with reference to FIG. 6, etc.

The door lock apparatus 1 includes a latch housing 9, as shown in FIGS. 1-5, and an actuating housing 7, as shown in FIGS. 1, 2, and 6-9. As shown in FIGS. 1 and 2, the actuating housing 7 is assembled onto (joined to) the latch housing 9. The latch housing 9 and the actuating housing 7 are representative, non-limiting examples of a "housing" according to the present teachings.

Figure 6:
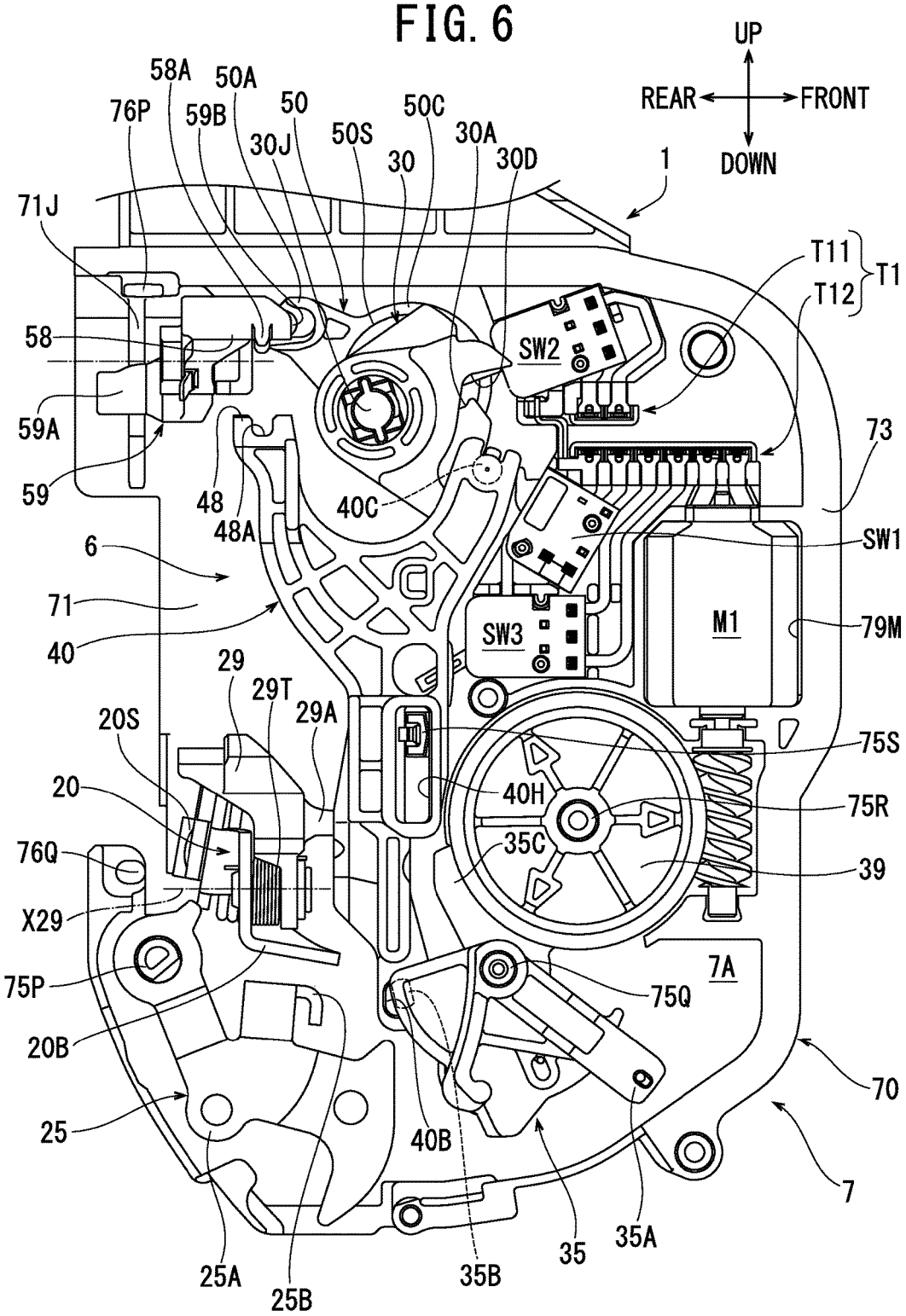
FIG. 6 is a front view of a first housing and an actuating mechanism.
Figure 7:
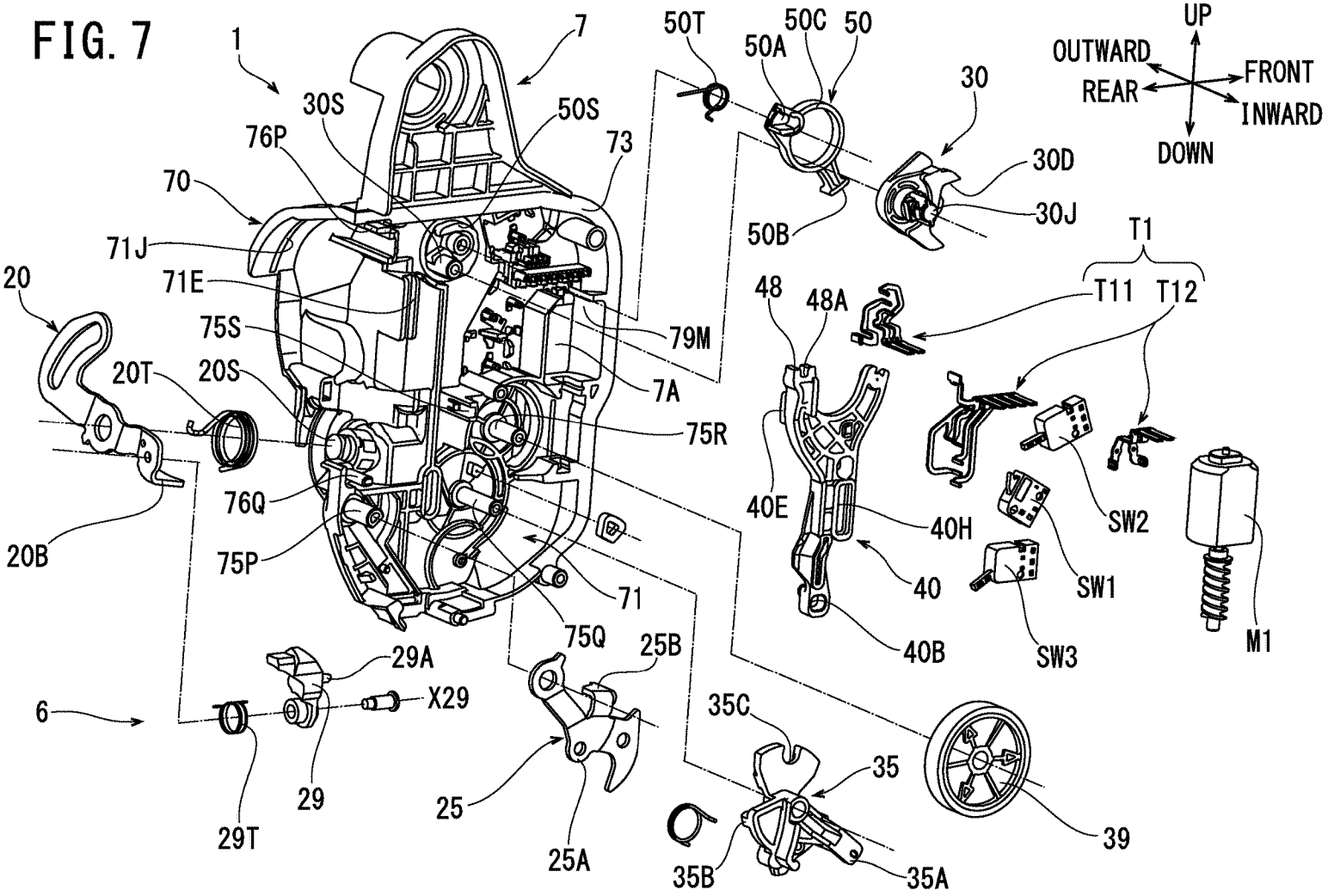
FIG. 7 is an exploded perspective view of the first housing and the actuating mechanism.
Figure 8:
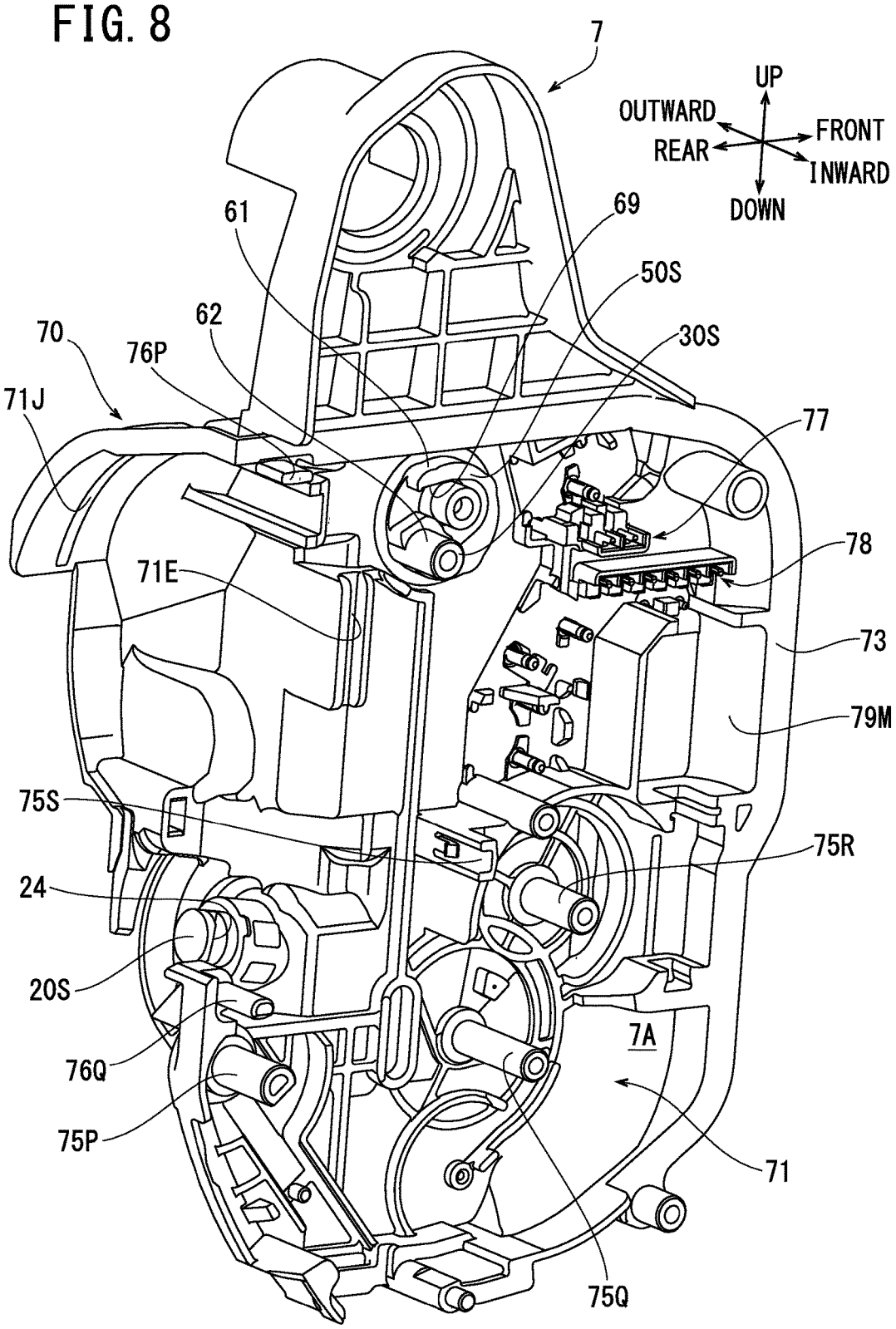
FIG. 8 is a perspective view of the first housing.
Figure 9:
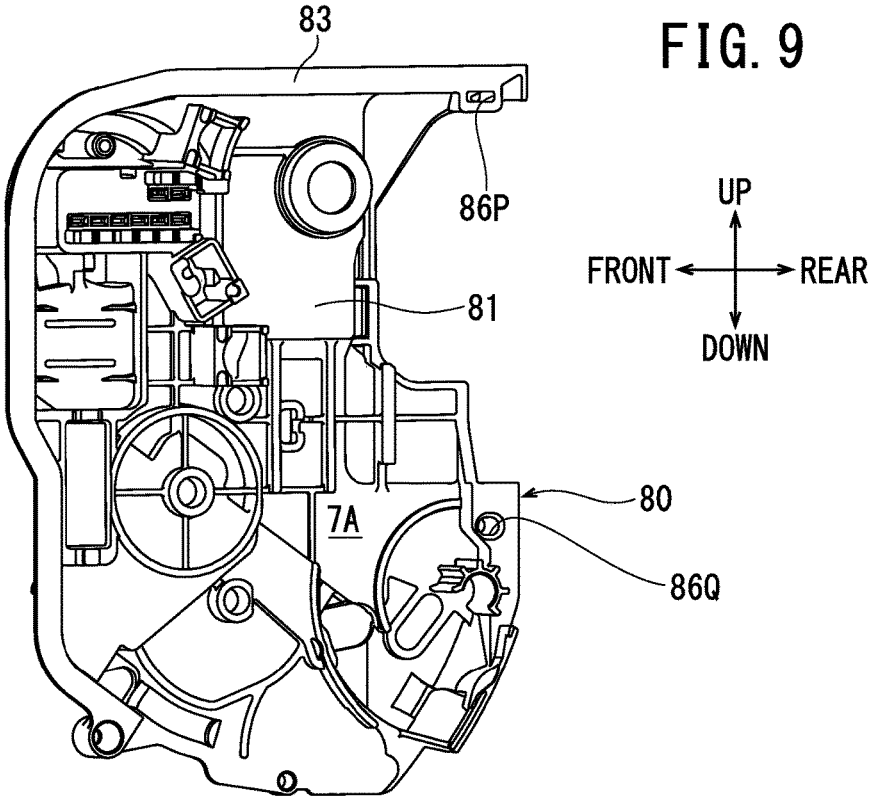
FIG. 9 is a perspective view of a second housing.

As shown, e.g., in FIGS. 7-9, the actuating housing 7 includes a first housing 70 and a second housing 80, each made of resin. As shown in FIG. 8, the first housing 70 includes a first peripheral edge section 73 surrounding a first base wall 71. As shown in FIG. 9, the second housing 80 includes a second peripheral edge section 83 surrounding a second base wall 81. The second housing 80 is assembled onto (joined to) the first housing 70 by disposing the first base wall 71 opposite to the second base wall 81 and welding the first peripheral edge section 73 to the second peripheral edge section 83, whereby a housing chamber 7A is formed in the interior of the actuating housing 7. An actuating mechanism 6, as shown in FIGS. 6, 7, and 10-19, is housed in the housing chamber 7A.

Figure 4:
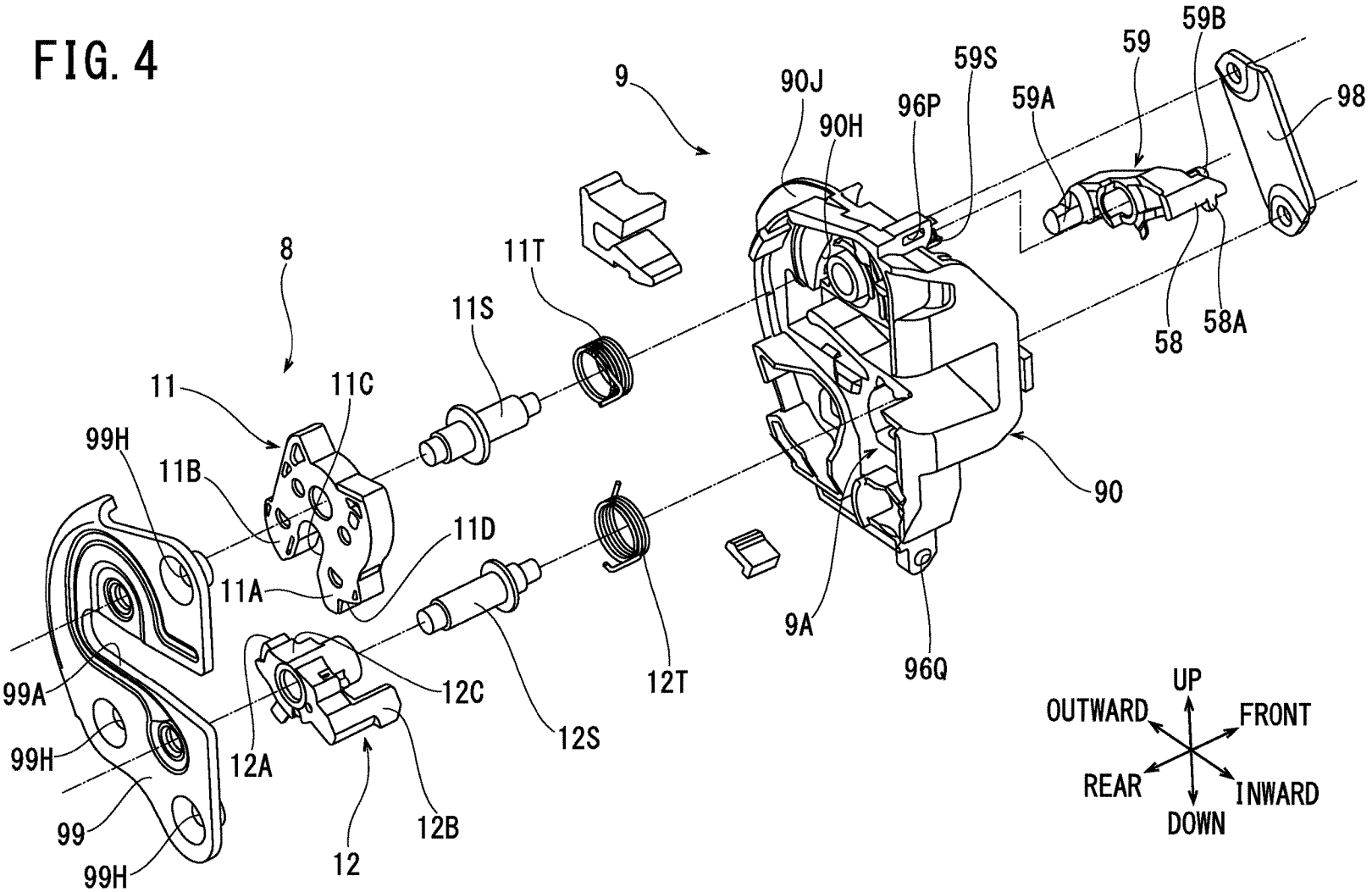
FIG. 4 is an exploded perspective view of the latch housing and the latch mechanism.

As shown in FIG. 4, the latch housing 9 includes a third housing 90 made of resin, as well as a base plate 99 and a back plate 98, which are each made from steel plate. A fork pivot shaft 11S and a pawl pivot shaft 12S are inserted through the third housing 90. The base plate 99 is disposed behind the third housing 90. The back plate 98 is disposed in front of the third housing 90. The rear end portions of the fork pivot shaft 11S and the pawl pivot shaft 12S are respectively crimped and thereby affixed to the base plate 99. The front end portions of the fork pivot shaft 11S and the pawl pivot shaft 12S are respectively crimped and thereby affixed to the back plate 98, whereby a latch chamber 9A is formed in the interior of the latch housing 9. A latch mechanism 8, as shown in FIGS. 2, 4, and 12-15, is housed in the latch chamber 9A.

As shown in FIGS. 6-8, first and second supports 76P and 76Q are formed in (on) the first housing 70. The first support 76P projects from the first base wall 71 near a rear and upper end portion in the first peripheral edge section 73 of the first housing 70. The second support 76Q projects from the first base wall 71 near a rear and lower end portion in the first peripheral edge section 73 of the first housing 70. The first and second supports 76P and 76Q each extend toward the second base wall 81 of the second housing 80.

Figure 3:
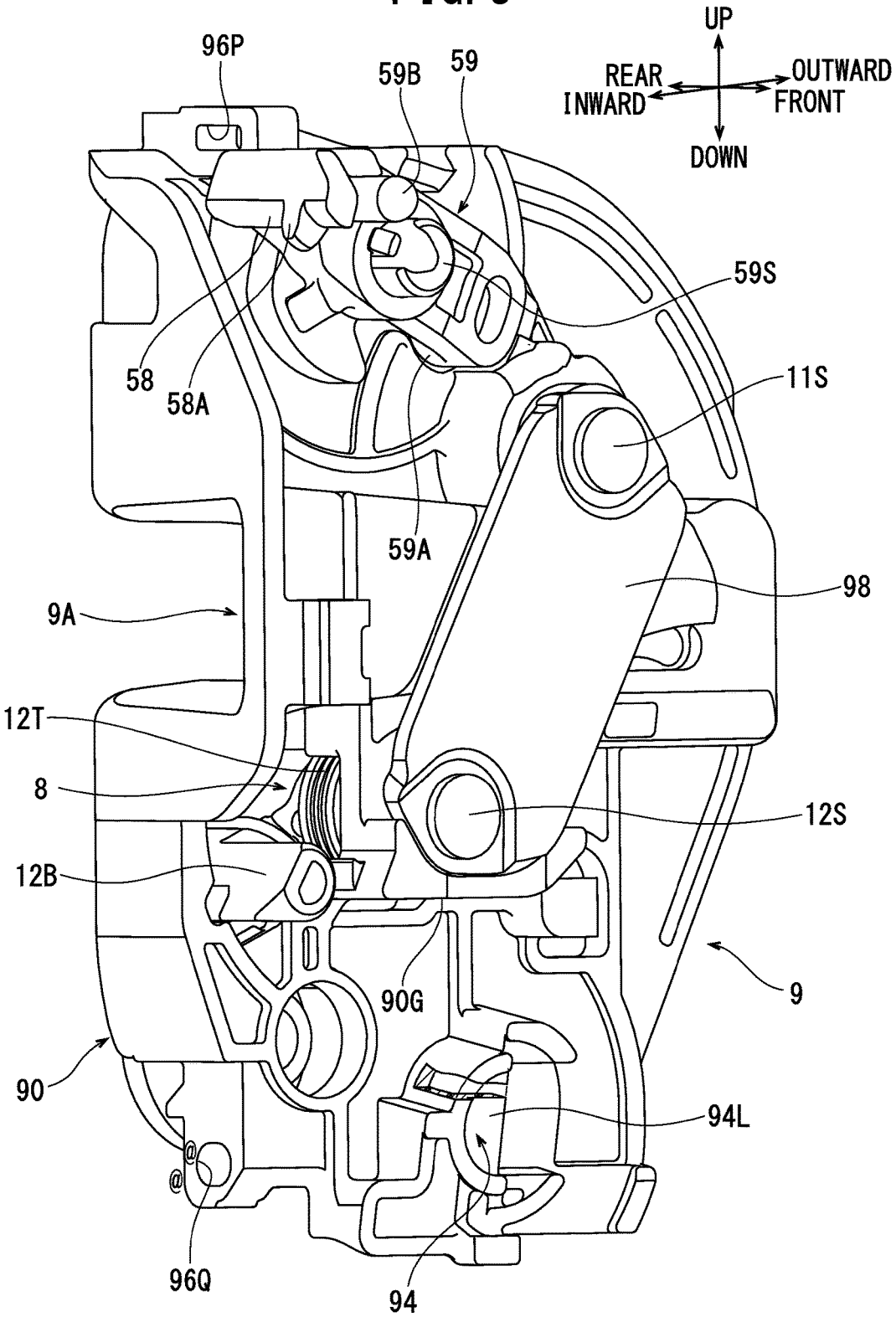
FIG. 3 is a perspective view of a latch housing and a latch mechanism of the first embodiment.

As shown in FIGS. 3 and 4, first and second insertion-through holes 96P and 96Q are formed in the third housing 90. The first insertion-through hole 96P penetrates through the upper end of the third housing 90 in the vehicle inward-outward direction. The second insertion-through hole 96Q penetrates through the lower end of the third housing 90 in the vehicle inward-outward direction.

As shown in FIG. 9, first and second slip-off preventing parts 86P and 86Q are formed as recesses (holes) in the second housing 80. The first slip-off preventing part 86P is a recess (hole) formed near a rear and upper end of the second peripheral edge section 83 of the second housing 80. The first slip-off preventing part 86P is aligned with the distal end of the first support 76P. The second slip-off preventing part 86Q is a recess (hole) formed near a rear and lower end of the second peripheral edge section 83 of the second housing 80. The second slip-off preventing part 86Q is aligned with the distal end of the second support 76Q.

Figure 5:
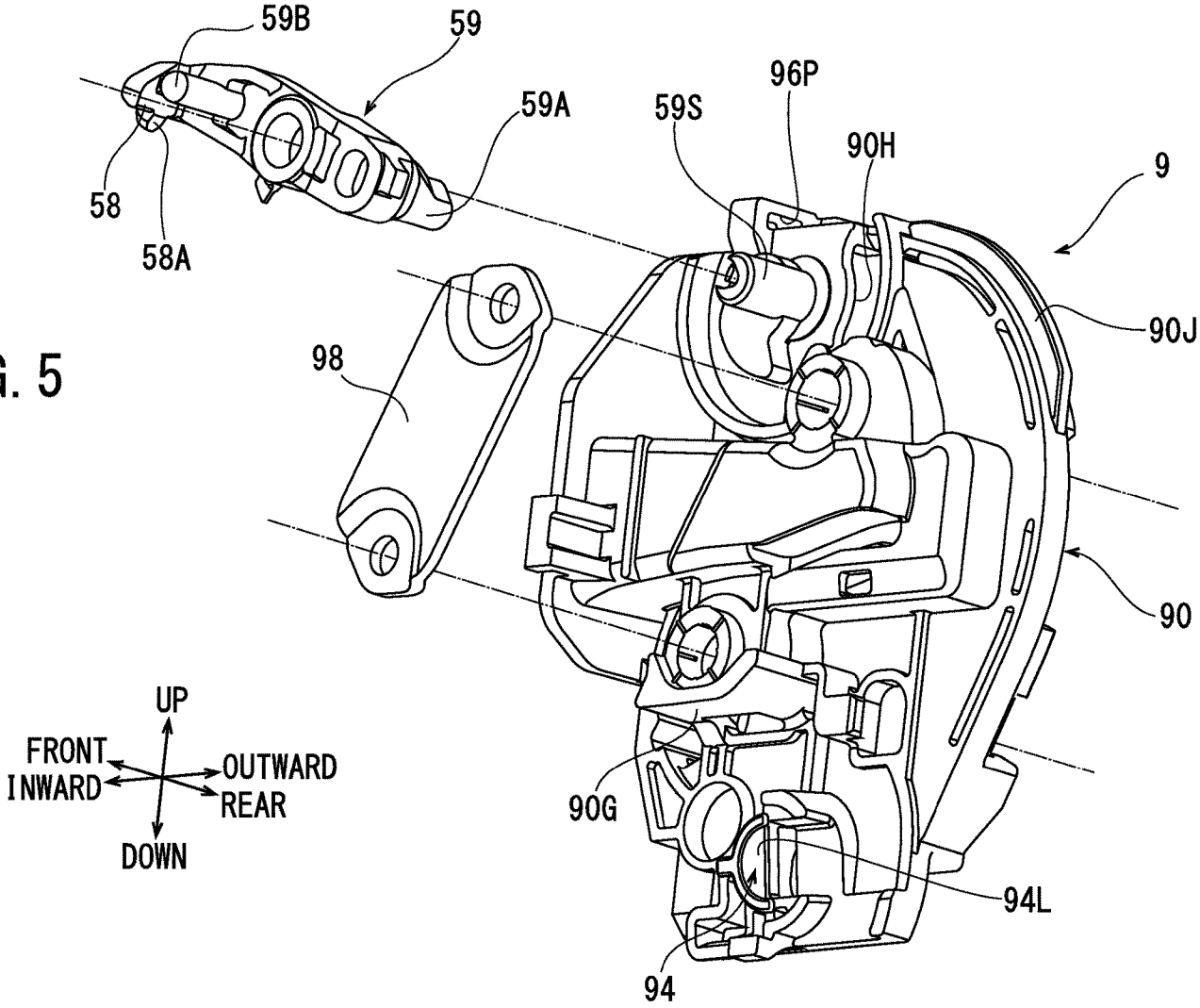
FIG. 5 is an exploded perspective view of the latch housing, a back plate, and a fork following lever.

Before the second housing 80 is assembled onto the first housing 70, the third housing 90 is provisionally assembled (mounted) onto the first housing 70. As shown, e.g., in FIG. 8, the first housing 70 includes a groove-like guide 71J formed in the rear end portion of the first base wall 71. As shown in FIGS. 4 and 5, a rib 90J protrudes from an upper end face of the third housing 90 towards the vehicle exterior. By moving the third housing 90 towards to the first housing 70 while guiding the rib 90J into the guide 71J, the third housing 90 can be provisionally assembled with the first housing 70 in the proper position (orientation).

As a result, the intermediate segment of the first support 76P of the first housing 70 is inserted through the first insertion-through hole 96P of the third housing 90. Similarly, the intermediate segment of the second support 76Q of the first housing 70 is inserted through the second insertion-through hole 96Q of the third housing 90.

Subsequently, when the second housing 80 is assembled (mounted) onto the first housing 70, the distal end of the first support 76P of the first housing 70 is fit into the first slip-off preventing part 86P of the second housing 80. The distal end of the second support 76Q of the first housing 70 is fit into the second slip-off preventing part 86Q of the second housing 80. The first peripheral edge section 73 of the first housing 70 and the second peripheral edge section 83 of the second housing 80 are welded together, whereby the third housing 90 is joined to the first housing 70 and the second housing 80.

As shown in FIGS. 2 and 4, a plurality of fixing holes 99H and an entry opening 99A are formed in the base plate 99. Not-shown set screws are inserted through the rear end face of the door and are respectively screwed into the fixing holes 99H of the base plate 99, whereby the door lock apparatus 1 is affixed to the door such that the entry opening 99A is exposed to the rear end face of the door. When the door lock apparatus 1 moves in accordance with the opening and closing of the door, the striker affixed to the vehicle frame separates (exits) from or enters the entry opening 99A.

As shown in FIG. 4, the latch mechanism 8 includes a fork 11 and a pawl 12. The fork 11 is pivotably supported by a fork pivot shaft 11S, which is disposed above the entry opening 99A. A torsion coil spring 11T is attached to the fork pivot shaft 11S. The pawl 12 is pivotably supported by the pawl pivot shaft 12S, which is disposed below the entry opening 99A. A torsion coil spring 12T is attached to the pawl pivot shaft 12S.

Figure 12:
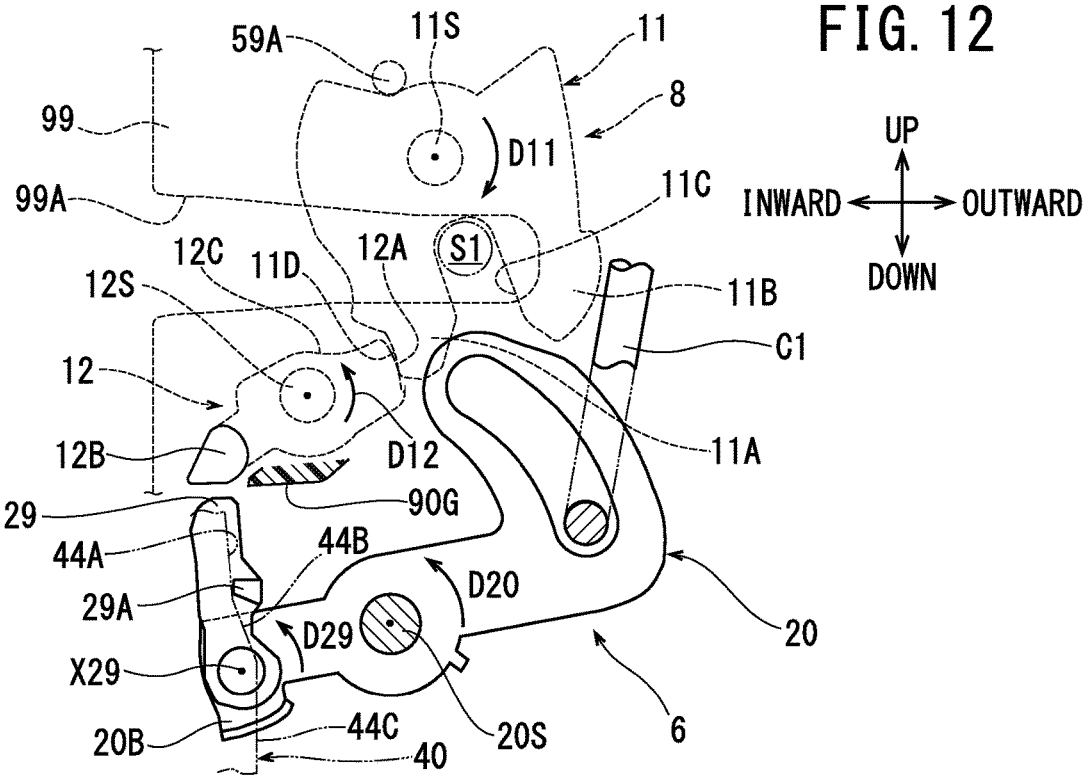
FIG. 12 is a first schematic view for explaining the operations of an outside O/S ("O/S") open lever, an inertial lever, a fork, and a pawl.

As shown in FIG. 12, the fork 11 is urged (biased) by the torsion coil spring 11T so as to pivot about the fork pivot shaft 11S in the direction D11. The portion of the fork 11 that is located on the side of the entry opening 99A has an inner convex segment 11A and an outer convex segment 11B. A striker S1, which is shown in FIG. 12 as having entered into the entry opening 99A, fits in a cutout 11C formed between the inner convex segment 11A and the outer convex segment 11B. In the state shown in FIG. 12, the fork 11 retains the striker S1 at the bottom of the entry opening 99A. A latch surface 11D configured to come into contact with a stopper surface 12A, which will be explained below, is formed at (on) the distal end of the inner convex segment 11A that faces the pawl 12.

The pawl 12 is urged (biased) by the torsion coil spring 12T so as to pivot about the pawl pivot shaft 12S in the direction D12 and holds the posture (orientation) shown in FIG. 12.

The stopper surface 12A is formed in (on) a portion of the pawl 12 that is directed towards the bottom of the entry opening 99A in the orientation shown in FIG. 12. The stopper surface 12A is formed so as to face the latch surface 11D. An arc forming the stopper surface 12A is cut on the side that faces the fork 11. A sliding surface 12C that extends towards the pawl pivot shaft 12S is formed starting from the part (location) where the arc is cut. A contact convex portion 12B is formed on the pawl 12 on the side that is opposite of the stopper surface 12A across the pawl pivot shaft 12S. As shown in FIG. 4, the contact convex portion 12B projects forward and has a columnar shape. As shown in FIG. 3, the front end of the contact convex portion 12B projects forward from the latch chamber 9A through the third housing 90 and enters the housing chamber 7A.

Referring again to FIG. 12, when the fork 11 retains (holds) the striker S1 at the bottom of the entry opening 99A, the stopper surface 12A comes into contact with the latch surface 11D of the inner convex segment 11A, whereby the pawl 12 prevents the fork 11 from pivoting in the direction D11. The position of the fork 11 shown in FIG. 12 is the latched position that holds the striker S1 in the entry opening 99A.

Figure 13:
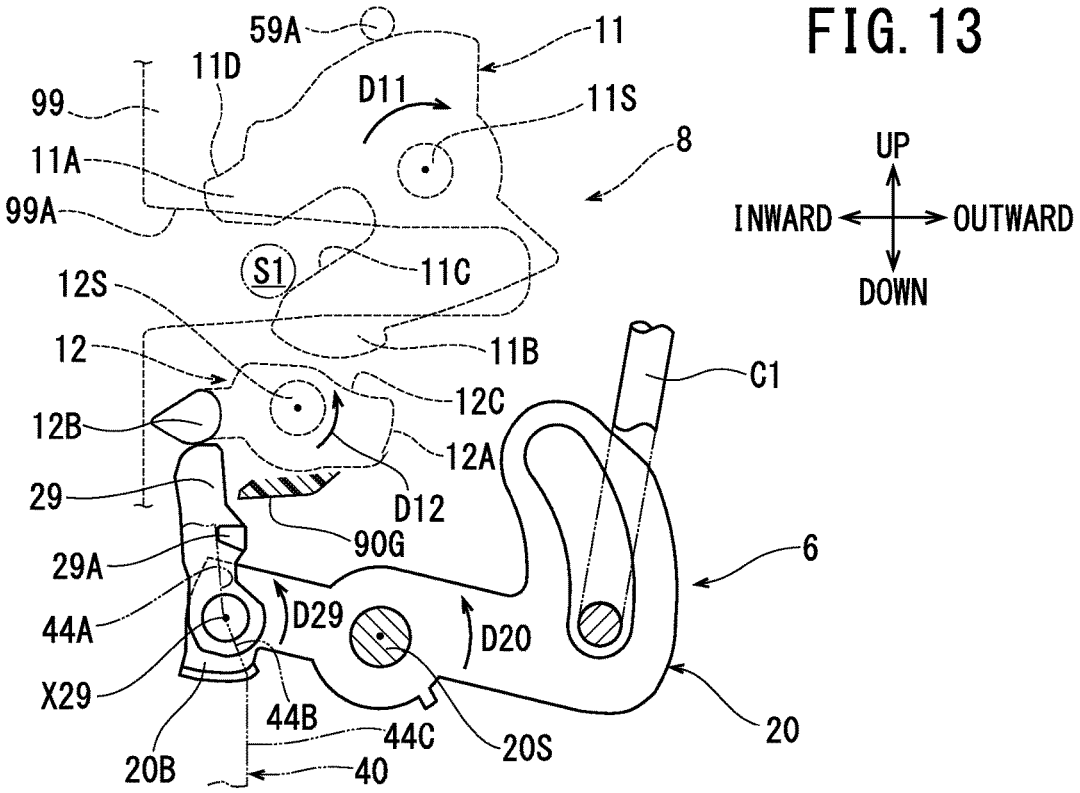
FIG. 13 is a second schematic view for explaining the operations of the O/S open lever, the inertial lever, the fork, and the pawl.

As shown in FIG. 13, when an inertial lever 29, which will be explained below, comes into contact with the contact convex portion 12B of the pawl 12 and pushes the contact convex portion 12B up, the pawl 12 pivots about the pawl pivot shaft 12S in the direction opposite of the direction D12 by overcoming the urging force of the torsion coil spring 12T. At this time, since the stopper surface 12A separates from the latch surface 11D, the pawl 12 no longer blocks the pivoting movement of the fork 11. Therefore, the fork 11 pivots about the fork pivot shaft 11S in the direction D11 due to the urging force of the torsion coil spring 11T so as to displace to the unlatched position, where the striker S1 is permitted (released) to move out of (exit) the entry opening 99A.

Conversely, when the striker S1 enters the entry opening 99A, the striker S1 pushes against the outer convex segment 11B, thereby causing the fork 11 to pivot in the direction opposite of the direction D11 and to return from the unlatched position shown in FIG. 13 to the latched position shown in FIG. 12. At this time, the distal end of the outer convex segment 11B and then the distal end of the inner convex portion 11A sequentially come into slide-contact with the sliding surface 12C. When the inner convex segment 11A separates from the sliding surface 12C, the pawl 12 pivots in the direction D12 and returns to the original posture shown in FIG. 12. Therefore, the stopper surface 12A comes into contact with the latch surface 11D and fixes the pivoting movement of the fork 11 in the latched position. As a result, the latch mechanism 8 holds the door closed with respect to the vehicle frame.

As shown in FIGS. 3 to 5, a fork following lever pivot shaft 59S projects forward from an upper part of the surface of the third housing 90 that is on the side of the housing chamber 7A. A fork following lever 59 is pivotably supported by (on) the fork following lever pivot shaft 59S. The fork following lever 59 is a representative, non-limiting example of a "fourth lever" according to the present teachings.

As shown in FIGS. 4 and 5, an actuated (passive) convex portion 59A having a substantially columnar shape is formed at one end portion of the fork following lever 59. In the third housing 90, an opening 90H penetrates in the front-rear direction near the fork following lever pivot shaft 59S. The actuated convex portion 59A projects rearward, passes through the opening 90H and enters the latch chamber 9A.

As shown in FIGS. 12 to 15, the distal end portion of the actuated convex portion 59A is in contact with the outer peripheral surface of the fork 11 in the latch chamber 9A.

As shown in FIGS. 3 to 5, except for the distal end portion of the actuated convex portion 59A, the fork following lever 59 is housed in the housing chamber 7A. An actuating convex portion 59B and a contact portion 58 are formed at (on) the other end portion of the fork following lever 59. The actuating convex portion 59B projects forward in a substantially columnar shape. The distal end portion of the actuating convex portion 59B is rounded in a hemispherical shape. The contact portion 58 projects forward in a substantially columnar shape to a position that is spaced farther from the fork following lever pivot shaft 59S than the actuating convex portion 59B. The lower end surface of the contact portion 58 extends substantially flat in the front-rear direction. A convex portion 58A projects downward from an intermediate portion of the lower end surface.

As shown in FIGS. 12 to 15, because the actuated convex portion 59A is in slide contact with the outer peripheral surface of the fork 11 as (while) the fork 11 displaces from the latched position to the unlatched position and vice versa, the fork following lever 59 pivots in an interlocked (linked) manner with the fork 11 and displaces from a blocking position to an unblocking position and vice versa.

Figure 14:
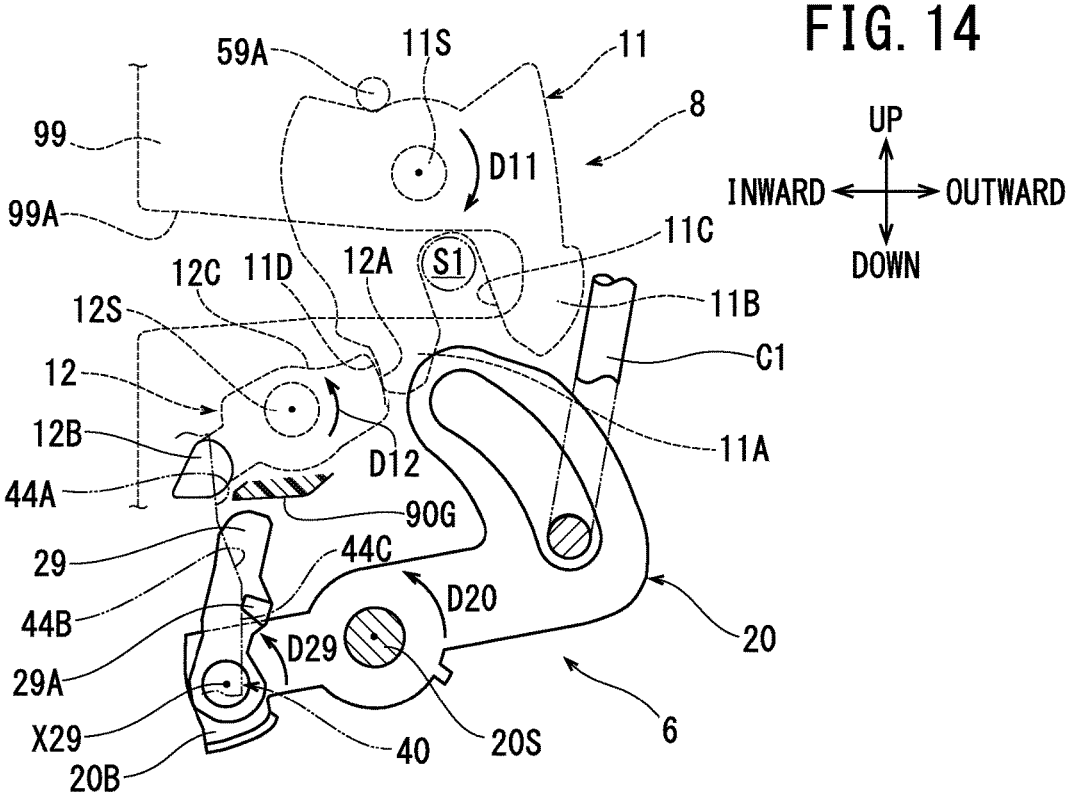
FIG. 14 is a third schematic view for explaining the operations of the O/S open lever, the inertial lever, the fork, and the pawl.
Figure 15:
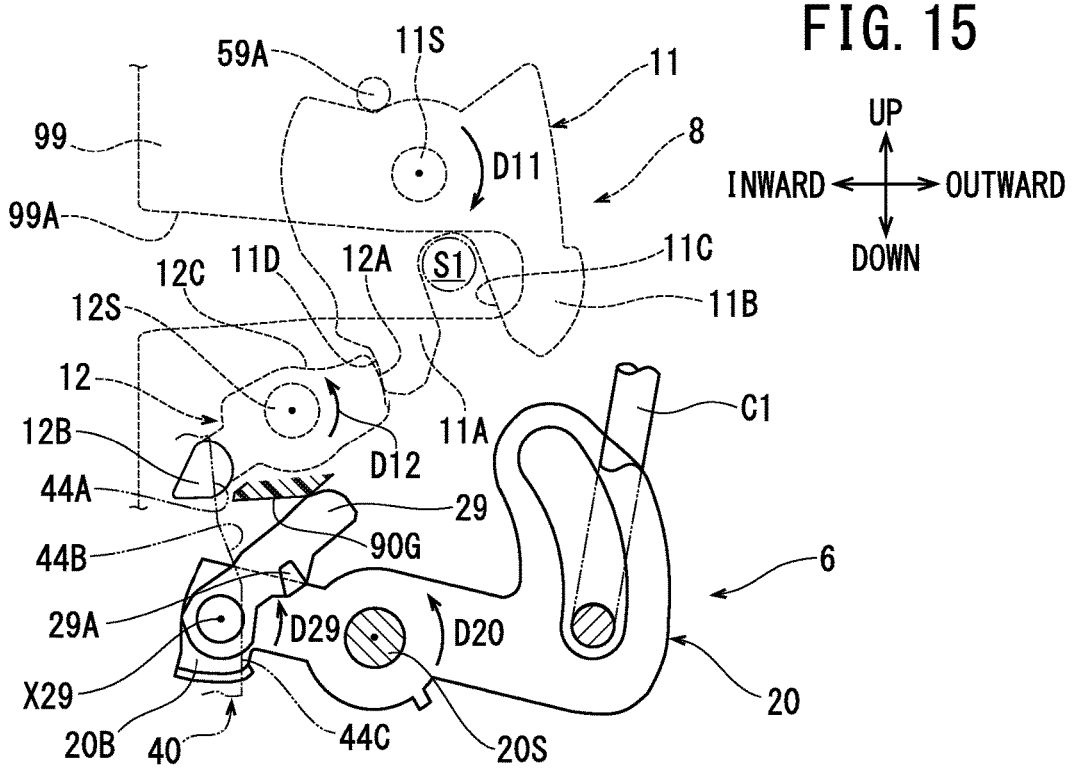
FIG. 15 is a fourth schematic view for explaining the operations of the O/S open lever, the inertial lever, the fork, and the pawl.

More specifically, as shown in FIGS. 12, 14, and 15, when the fork 11 is displaced to the latched position, the actuated convex portion 59A is displaced downward to approach the fork pivot shaft 11S. Consequently, the fork following lever 59 is displaced to the unblocking position shown in FIGS. 3, 6, 11, 16, 18A and 18B and displaces (pushes) the contact portion 58 upward.

As shown in FIG. 13, when the fork 11 is displaced to the unlatched position, the actuated convex portion 59A is displaced upward to be spaced farther apart from the fork pivot shaft 11S. Consequently, the fork following lever 59 is displaced to the blocking position shown in FIGS. 19A and 19B and displaces the contact portion 58 downward.

As shown in FIGS. 6, 7, 10 and 11, the actuating mechanism 6 includes the O/S open lever 20, the I/S open lever 25, the inertial lever 29, the O/S lock lever 30, the I/S lock lever 35, a linearly moving lock lever 40, an electric motor Ml, a worm wheel 39, an adjuster switch (SW) lever 50, a first switch SW1, a second switch SW2, a third switch SW3, and a plurality of terminals T1. These components are all housed in the housing chamber 7A except for (i) one end portion of the O/S open lever 20 that projects to the outside of the actuating housing 7 as shown in FIG. 1 and (ii) projecting end portions of the plurality of terminals T1 that project toward a connector 80C shown in FIG. 2. The fork following lever 59 also constitutes a part of the actuating mechanism 6.

The inertial lever 29 is a representative, non-limiting example of a "first lever" according to the present teachings. The linearly moving lock lever 40 is a representative, non-limiting example of a "second lever" according to the present teachings. The O/S lock lever 30 and the I/S lock lever 35 are representative, non-limiting examples of a "third lever" according to the present teachings. The adjuster SW lever 50 is a representative, non-limiting example of a "fifth lever" according to the present teachings. The first switch SW1 is a representative, non-limiting example of a "switch" according to the present teachings.

As shown in FIGS. 7 and 8, the first housing 70 includes an outside ("O/S") open lever pivot shaft 20S that projects rearward at (from) a rear and lower portion of the first base wall 71.

As shown in FIGS. 6 to 8, a first shaft 75P is formed in (on) a rear and lower part of the first base wall 71 of the first housing 70. A second shaft 75Q is formed in (on) a part of the first base wall 71 that is farther forward than the first shaft 75P. A third shaft 75R and a fourth shaft 75S are formed in (on) a part located substantially in the center of the first base wall 71. The first shaft 75P, the second shaft 75Q, the third shaft 75R, and the fourth shaft 75S respectively extend toward the second base wall 81 of the second housing 80.

The O/S open lever 20 is pivotably supported by the O/S open lever pivot shaft 20S. As shown in FIG. 7, a torsion coil spring 20T is attached to the O/S open lever pivot shaft 20S. As shown in FIG. 12, the O/S open lever 20 is urged (biased) by the torsion coil spring 20T so as to pivot about the O/S open lever pivot shaft 20S in the direction D20.

As shown in FIG. 8, a fitting groove 24 is formed as a recess in the O/S open lever pivot shaft 20S. As shown in FIGS. 3 and 5, a shaft receptacle 94, in which a fitting plate 94L is provided, is formed in the third housing 90. Although not shown in the Figures, the fitting groove 24 of the O/S open lever pivot shaft 20S fits with the fitting plate 94L of the shaft receptacle 94, whereby the O/S open lever 20 is prevented from slipping off from the O/S open lever pivot shaft 20S.

As shown in FIGS. 1 and 12, a first end of the O/S open lever 20 projects outward of the actuating housing 7. The lower end of the transmission rod C1 is coupled to this first end.

As shown in FIGS. 6 and 7, the inertial lever 29 is supported by a second end 20B of the O/S open lever 20 so as to be pivotable about a pivot axis X29 that extends in the front-rear direction. The inertial lever 29 is urged (biased) by a torsion coil spring 29T (shown in FIG. 7) to pivot about the pivot axis X29 in the direction D29 shown in FIG. 12.

When the exterior door handle H1 is operated (e.g., manually pulled) to open the door and the transmission rod C1 has moved downward as shown in FIG. 13, the first end of the O/S open lever 20 that is linked to the transmission rod C1 is pushed down too. The O/S open lever 20 pivots in the direction opposite of the direction D20, thereby raising the inertial lever 29.

As shown in FIGS. 6 and 7, the I/S open lever 25 is pivotably supported by the first shaft 75P. The second end of the transmission cable C4 (see FIGS. 1 and 2) is operably coupled to one end 25A of the I/S open lever 25 that is spaced downward from the first shaft 75P. That is, the I/S open lever 25 is operably coupled to the interior door handle H4 via the transmission cable C4.

As shown in FIGS. 6 and 7, an operating part 25B is formed on a part above the one end 25A of the I/S open lever 25. The I/S open lever 25 pivots counterclockwise when the interior door handle H4 is operated (e.g., manually pulled) to open the door. Consequently, the operating part 25B pushes the other end 20B of the O/S open lever 20 up and raises the inertial lever 29.

As shown in FIG. 8, the first housing 70 includes an adjuster switch ("SW") lever pivot shaft (rounded portion) 50S that projects from an upper portion of the first base wall 71 toward the vehicle interior. An outside ("O/S") lock lever pivot shaft 30S projects from the end face of the adjuster SW lever pivot shaft 50S toward the vehicle interior.

More specifically, the adjuster SW lever pivot shaft 50S is a substantially columnar body, and an at least substantially annular first guide surface 61 is formed (defined) on the outer circumference thereof. The first guide surface 61 is constituted by a cylindrical surface and by curved surfaces that slightly swell (bulge, protrude) from (at) a plurality of portions of the cylindrical surface.

A spring housing 69 is formed as a recess extending in the vehicle outward direction and is partially defined by a radially-inward side of the first guide surface 61 of the adjuster SW lever pivot shaft 50S, i.e. the spring housing 69 is located within the upper rear portion of the end face of the adjuster SW lever pivot shaft 50S. A torsion coil spring 50T, as shown in FIG. 7, is housed within the spring housing 69.

As shown in FIG. 8, the O/S lock lever pivot shaft 30S is shaped as a cylindrical body, and a cylindrical second guide surface 62 is formed on the outer circumference thereof. The second guide surface 62 is located farther in the vehicle inward direction than the first guide surface 61, is radially spaced apart from the adjuster SW lever pivot shaft 50S and is located below and/or rearward from the spring housing 69. The outer diameter of the second guide surface 62 is less than one half of the outer diameter of the first guide surface 61.

Figure 16:
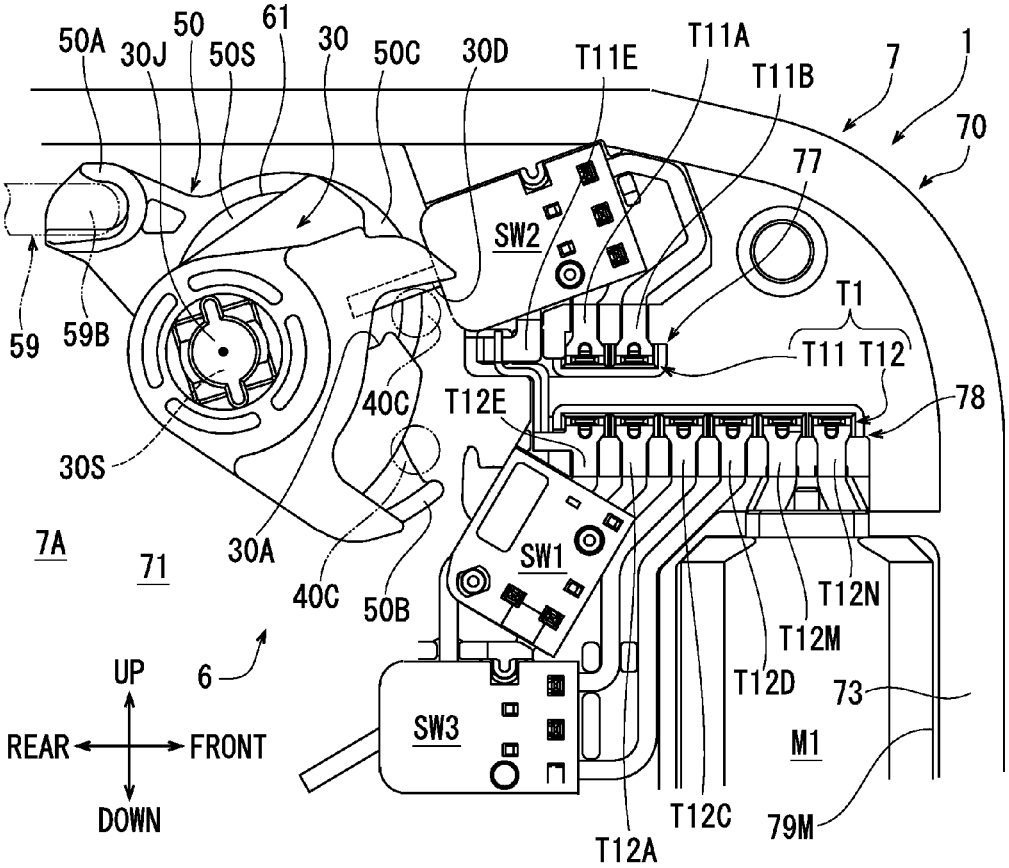
FIG. 16 is a schematic view for explaining the operations of an adjuster switch ("SW") lever and a first switch.
Figure 18B:
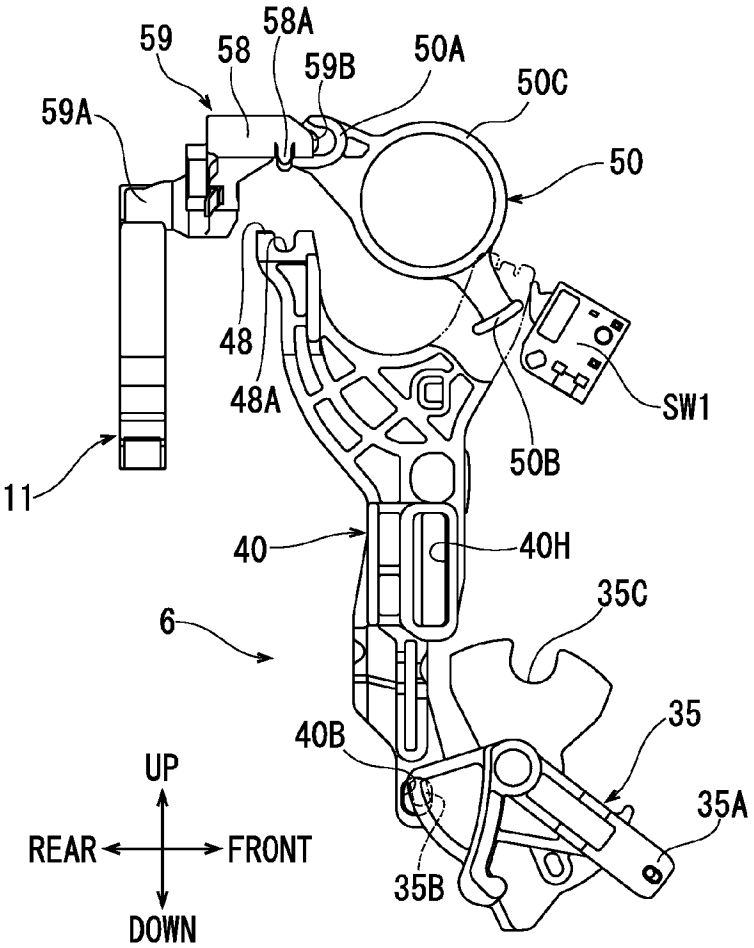
FIG. 18B is a view showing the fork located in the latched position, the fork following lever located in the unblocking position, the linearly moving lock lever located in the unlocking position, etc.
Figure 19B:
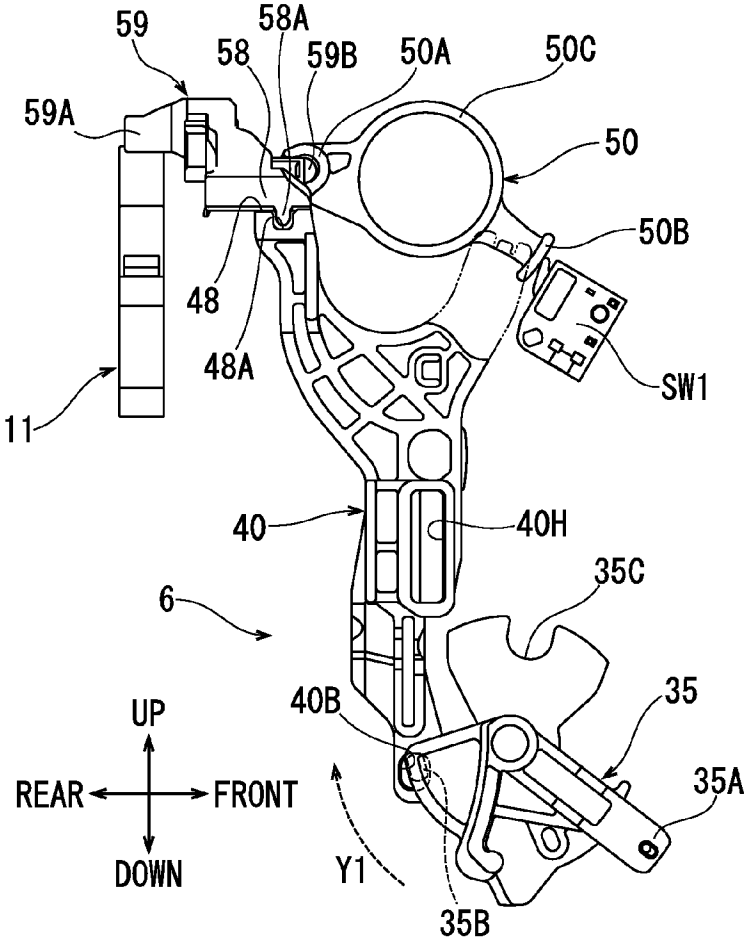
FIG. 19B is a view showing the fork located in the unlatched position, the fork following lever located in the blocking position, the linearly moving lock lever located in the unlocking position, etc.

As shown, e.g., in FIGS. 16, 18B and 19B, the adjuster SW lever 50 includes a ring 50C, an input part 50A, and an output part 50B. As shown in FIG. 16, the ring 50C is rotatably disposed around the first guide surface 61, whereby the adjuster SW lever 50 is pivotably supported by the adjuster SW lever pivot shaft 50S. Although not shown in the Figures, one end T1 of the torsion coil spring 50T shown in FIG. 7 engages with (in) the ring 50C. Consequently, in the view shown in FIG. 16, the adjuster SW lever 50 is urged (biased) in the clockwise direction. The input part 50A projects rearward from a rear portion on the outer circumferential surface of the ring 50C. The actuating convex portion 59B of the fork following lever 59 (see FIGS. 3 and 18B) is coupled to the input part 50A. The output part 50B projects frontward and downward from a front, downward portion of the outer circumferential surface of the ring 50C and extends to the vicinity of (adjacent to) the first switch SW1.

The adjuster SW lever 50 is interlocked (linked) with the fork following lever 59, detects whether the fork 11 is located in the latched position or the unlatched position, and disconnects or connects (i.e. turns OFF or turns ON) the first switch SW1.

More specifically, when the fork following lever 59 follows the movement of the fork 11 to the unlatched position and pivots from the position shown in FIGS. 16 and 18B to the position shown in FIG. 19B, this pivoting movement is transmitted to the adjuster SW lever 50 via the actuating convex portion 59B. Therefore, the adjuster SW lever 50 pivots from the position shown in FIGS. 16 and 18B to the position shown in FIG. 19B and causes the first switch SW1 to be turned ON (connected). The position of the adjuster SW lever 50 shown in FIGS. 16 and 18B is an interior light (dome light) OFF position corresponding to the latched position of the fork 11. The position of the adjuster SW lever 50 shown in FIGS. 6 and 11 also serves as the interior light (dome light) OFF position. The position of the adjuster SW lever 50 shown in FIG. 19B is an interior light (dome light) ON position corresponding to the unlatched position of the fork 11. The ON/OFF signal provided by the first switch SW1 is used to turn ON and OFF the vehicle interior light (i.e. the dome light within the passenger cabin of the vehicle).

As shown in FIG. 7, the O/S lock lever 30 is pivotably supported by the O/S lock lever pivot shaft 30S. Although not shown in the Figures, a shaft hole (blind hole) is defined within the O/S lock lever 30 and has an inner diameter that is slightly larger than the outer diameter of the second guide surface 62 of the O/S lock lever pivot shaft 30S. The O/S lock lever pivot shaft 30S, as shown in FIG. 8, is inserted into the shaft hole to place the O/S lock lever 30 adjacent to the adjuster SW lever 50. That is, the adjuster SW lever 50 and the O/S lock lever 30 are thereby stacked (disposed in series) in the vehicle inward-outward direction.

Figure 17:
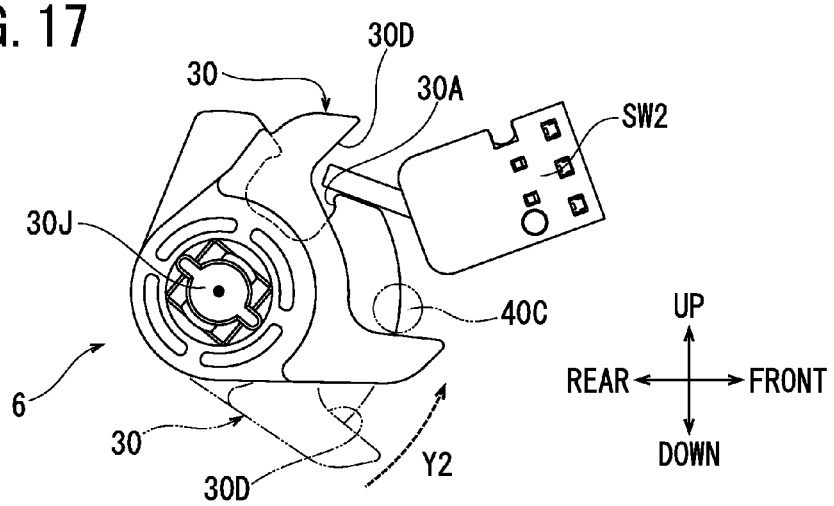
FIG. 17 is a schematic view for explaining the operations of an O/S lock lever and a second switch.

As shown, e.g., in FIGS. 16 and 17, the O/S lock lever 30 includes a switch engaging part 30A, an engaging concave segment 30D, and a coupling shaft 30J. The switch engaging part 30A is recessed in the radial inward direction of the O/S lock lever pivot shaft 30*s*. A lever of the second switch SW2 engages in the inside of the switch engaging part 30A. The engaging concave segment 30D is recessed in the radial inward direction farther in the vehicle inward direction than the switch engaging part 30A. The coupling shaft 30J projects from a surface adjacent to the engaging concave segment 30D in the vehicle inward direction coaxially with the O/S lock lever pivot shaft 30S. As shown in FIG. 2, the coupling shaft 30J projects to the outside of the second housing 80. The link lever C2C is fixed to the distal end portion of the coupling shaft 30J so as to be integrally rotatable therewith.

Referring to FIG. 16, the O/S lock lever 30 pivots counterclockwise in response to a locking operation being performed on the key cylinder H2. When the O/S lock lever 30 pivots from the position shown in FIG. 16 to the position shown in FIG. 17, the O/S lock lever 30 turns ON (connects) the second switch SW2. The O/S lock lever 30 pivots clockwise in the view of FIG. 16 in response to an unlocking operation being performed on the key cylinder H2 and thereby turns OFF (disconnects) the second switch SW2. The ON/OFF signal of the second switch SW2 is used to control locking and unlocking of the door and to ascertain the state of the door lock apparatus 1.

As shown in FIGS. 6 and 7, the I/S lock lever 35 is pivotably supported by the second shaft 75Q. The second end of the transmission cable C3 (shown in FIGS. 1 and 2) is coupled to one end 35A of the I/S lock lever 35. That is, the I/S lock lever 35 is operably coupled to the interior door lock knob H3 via the transmission cable C3. The I/S lock lever 35 pivots from the position shown in FIG. 6 to the position shown in FIG. 11 in response to a locking operation being performed on the interior door lock knob H3. The I/S lock lever 35 pivots from the position shown in FIG. 11 to the position shown in FIG. 6 in response to an unlocking operation being performed on the interior door lock knob H3. The position of the I/S lock lever 35 shown in FIGS. 18B and 19B is the same as the position shown in FIG. 6.

Figure 10:
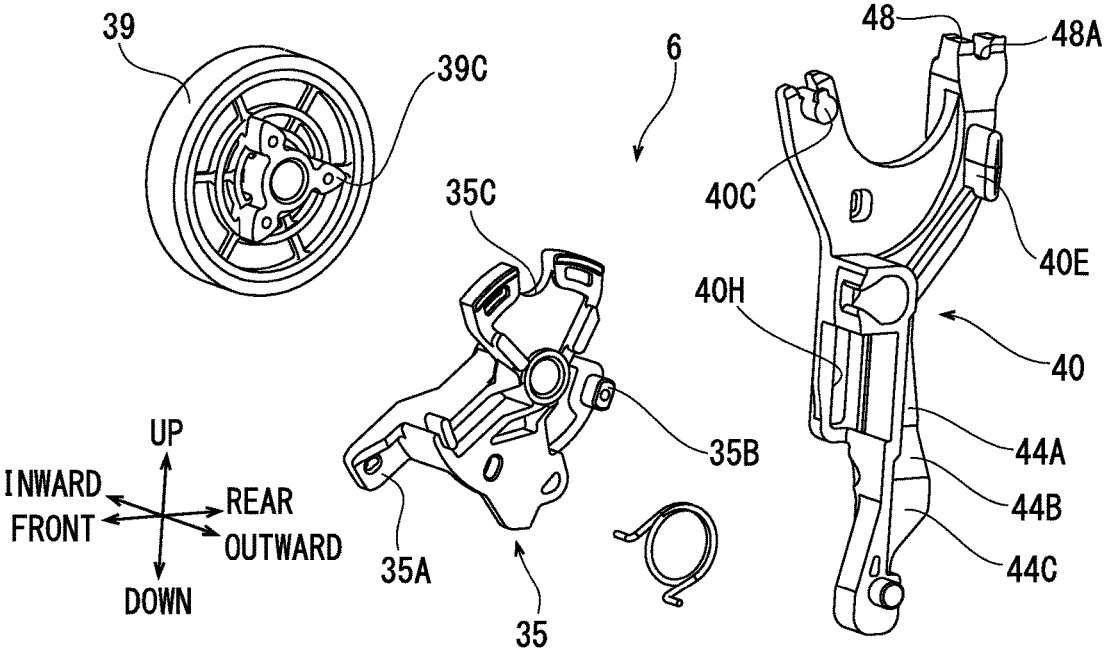
FIG. 10 is an exploded perspective view of a worm wheel, an inside ("I/S") lock lever, and a linearly moving lock lever.

As shown in FIGS. 6 and 7, a cam 35C is formed in an upper part of the I/S lock lever 35. As shown in FIG. 10, an operating part 35B projects toward the vehicle exterior from the surface of the I/S lock lever 35 that faces the vehicle exterior.

As shown in FIGS. 6 and 7, the worm wheel 39 is rotatably (turnably) supported by (on) the third shaft 75R. As shown in FIG. 10, a cam section 39C configured to engage with the cam 35C of the I/S lock lever 35 is formed on the surface of the worm wheel 39 that faces the vehicle exterior. When the electric motor Ml is actuated in response to a locking operation or an unlocking operation requested by a remote control key (e.g., a remote keyless entry fob) or the like, the worm wheel 39 is driven by the electric motor Ml to rotate and thereby turns (pivots) clockwise or counterclockwise. Due to the engagement of the cam section 39C and the cam 35C, the worm wheel 39 causes the I/S lock lever 35 to pivot between the position shown in FIG. 6 and the position shown in FIG. 11.

As shown in FIGS. 6 and 7, the fourth shaft 75S is inserted through an elongated hole 40H that extends in the up-down direction, whereby the linearly moving lock lever 40 is supported by the fourth shaft 75S so as to be linearly movable. The fourth shaft 75S has a substantial "C" shaped cross-section. The linearly moving lock lever 40 has a substantial "Y" shape that forks above the elongated hole 40H.

As shown in FIGS. 7 and 10, a linearly moving convex segment 40E projects toward the vehicle exterior from a part of the linearly moving lock lever 40 that branches rearward and upward. A linear-movement guide groove 71E extends in the up-down direction at a location that is upward and rearward relative to the fourth shaft section 75S; the linear-movement guide groove 71E is formed as a recess in the first base wall 71 of the first housing 70. The linearly moving convex segment 40E is guided by the linear-movement guide groove 71E, whereby the linearly moving lock lever 40 is capable of linearly moving in the up-down direction without inclining (tilting).

As shown in FIGS. 6 and 7, a concave recess 40B is formed in the lower end portion of the linearly moving lock lever 40. As shown in FIGS. 6, 11, 18A, 18B, 19A and 19B, the operating part 35B of the I/S lock lever 35 engages in the concave recess 40B.

As shown in FIG. 10, an engaging convex part 40C projects toward the vehicle exterior at (from) the distal end of a part of the linearly moving lock lever 40 that branches forward and upward. As shown in FIGS. 6, 11, 16 and 17, the engaging convex part 40C projects into the engaging concave segment 30D of the O/S lock lever 30.

As shown in FIG. 10, a contacted portion 48 is formed at the distal end of a part of the linearly moving lock lever 40 that branches backward and upward. The upper end face of the contacted portion 48 extends substantially flat in the front-rear direction. A concave portion 48A is formed as a recess that extends downward from an intermediate portion of the upper end face.

As explained below, when the fork following lever 59 is located in the unblocking position, the linearly moving lock lever 40 linearly moves in response to a locking operation and an unlocking operation being performed on the interior lock knob H3 and a locking operation and an unlocking operation being performed on the key cylinder H2.

That is, as shown, e.g., in FIGS. 6, 11, 18A and 18B, when the fork following lever 59 is located in the unblocking position, irrespective of the position of the linearly moving lock lever 40, the contact portion 58 separates (becomes spaced apart) from the contacted portion 48 of the linearly moving lock lever 40 in the upward direction so that it is unable to come into contact with the contacted portion 48. That is, when the fork following lever 59 is located in the unblocking position, the linearly moving lock lever 40 is allowed to linearly move up and down.

Figure 11:
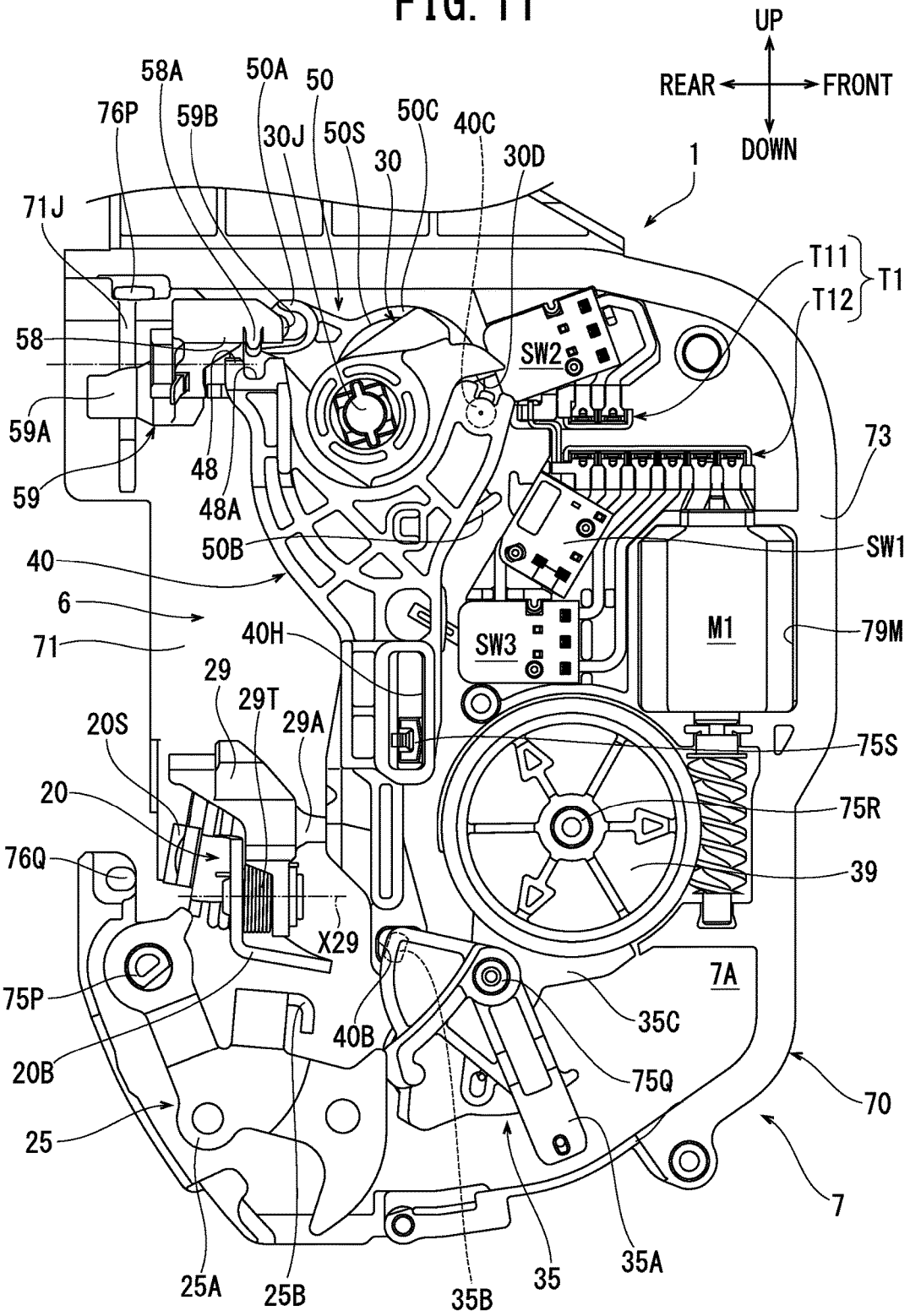
FIG. 11 is another front view of the first housing and the actuating mechanism.

In this state, when the I/S lock lever 35 pivots from the position shown in FIG. 6 etc., to the position shown in FIG. 11 in response to a locking operation being performed on the interior door lock knob H3 or a locking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pushed up from the position shown in FIGS. 6, 18A and 18B, to the position shown in FIG. 11.

When the I/S lock lever 35 pivots from the position shown in FIG. 11 to the position shown in FIG. 6, etc., in response to an unlocking operation being performed on the interior door lock knob H3 or an unlocking operation requested by the remote control key or the like, the displacement of the I/S lock lever 35 is transmitted to the linearly moving lock lever 40 via the concave recess 40B and the operating part 35B. As a result thereof, the linearly moving lock lever 40 is pulled down from the position shown in FIG. 11 to the position shown in FIGS. 6, 18A and 18B.

When the O/S lock lever 30 pivots counterclockwise in response to the locking operation being performed on the key cylinder H2 and displaces to the position shown in FIG. 17, the displacement of the O/S lock lever 30 is transmitted to the linearly moving lock lever 40 via the engaging concave segment 30D and the engaging convex part 40C. As a result thereof, the linearly moving lock lever 40 is lifted (pulled up) from the position shown in FIGS. 6, 18A and 18B to the position shown in FIG. 11.

When the O/S lock lever 30 pivots clockwise in response to the unlocking operation being performed on the key cylinder H2, the displacement of the O/S lock lever 30 is transmitted to the linearly moving lock lever 40 via the concave recess 40B and the operating part 35B. As a result thereof, the linearly moving lock lever 40 is pushed down from the position shown in FIG. 11 to the position shown in FIGS. 6, 18A and 18B.

Figure 19A:
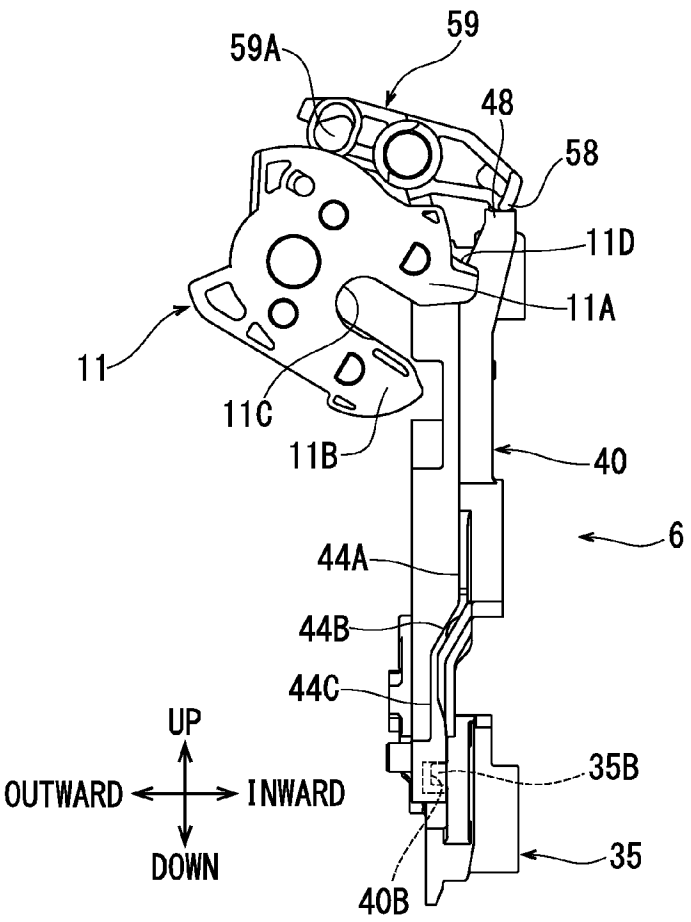
FIG. 19A is a side view showing the fork located in an unlatched position, the fork following lever located in a blocking position, the linearly moving lock lever located in the unlocking position, etc.

As shown in FIGS. 19A and 19B, when the fork following lever 59 is located in the blocking position, the contacted portion 48 of the linearly moving lock lever 40, which is in a downwardly displaced state/position, contacts and is stopped (blocked) from moving upwardly by the contact portion 58 of the fork following lever 59. At this time, because the convex portion 58A of the contact portion 58 projects toward the contacted portion 48 and enters (is inserted into) the concave portion 48A, displacement (shifting) of the contact portion 58 relative to the contacted portion 48 is suppressed (prevented). That is, when the fork following lever 59 is located in the blocking position, the linearly moving lock lever 40, which is in its downwardly displaced state/position, is inhibited (blocked) from being displaced to the position shown in FIG. 11.

As shown in FIGS. 10 and 12 to 15, a first surface 44A, a second surface 44B, and a third surface 44C are formed on the linearly moving lock lever 40 between the elongated hole 40H and the concave recess 40B. The first surface 44A, the second surface 44B, and the third surface 44C are formed on a surface of the linearly moving lock lever 40 that faces the vehicle exterior. The first surface 44A and the third surface 44C are each flat surfaces that extend in the up-down direction. The first surface 44A is displaced (shifted) more towards the vehicle interior than the third surface 44C. The second surface 44B is an inclined surface that connects the lower end of the first surface 44A with the upper end of the third surface 44C As shown in FIGS. 6, 7, and 12 to 15, a projection 29A projects forward from the front surface of the inertial lever 29. The projection 29A comes into slide-contact with the first surface 44A, the second surface 44B, and the third surface 44C in response to the linear movement of the linearly moving lock lever 40.

As shown in FIGS. 3, 5, and 12-15, an inertial lever guide surface 90G is formed on the third housing 90 on the side of the housing chamber 7A. The inertial lever guide surface 90G is a downward flat surface located farther towards the vehicle exterior than the contact convex portion 12B of the pawl 12. The inertial lever guide surface 90G extends toward the vehicle exterior so as to separate (be spaced) from the contact convex portion 12B. As shown in FIG. 12, when the O/S open lever 20 has not yet been pivoted, the inertial lever guide surface 90G is located between the lower end of the contact convex portion 12B and the upper end of the inertial lever 29 in the up-down direction.

Figure 18A:
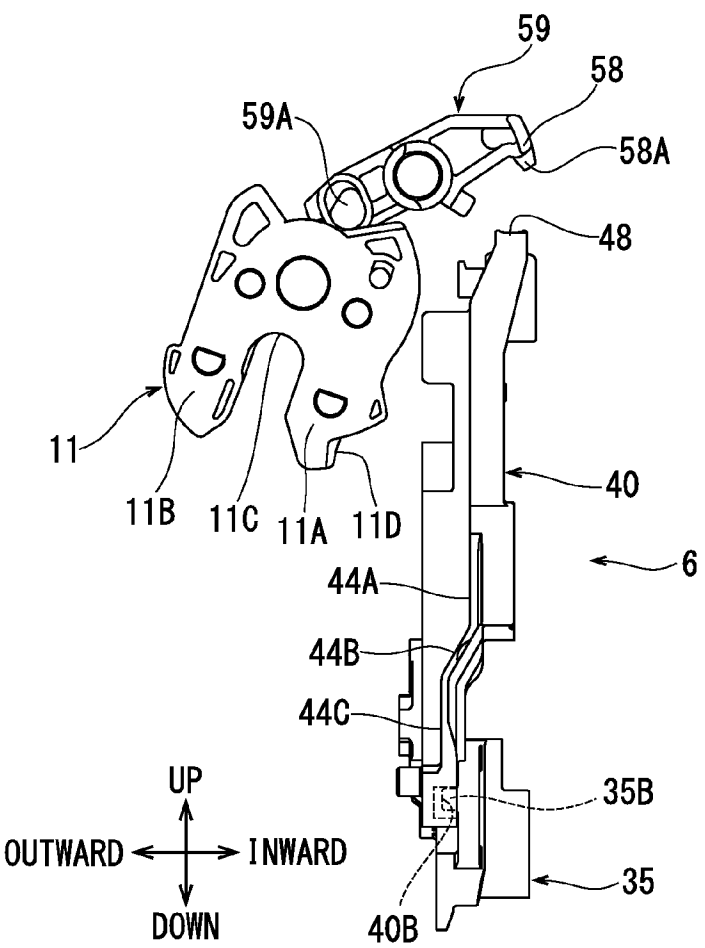
FIG. 18A is a side view showing the fork located in a latched position, the fork following lever located in an unblocking position, a linearly moving lock lever located in an unlocking position, etc.

The position of the linearly moving lock lever 40 shown in FIGS. 12 and 13 is the same as the position of the linearly moving lock lever 40 shown in FIGS. 6, 18A and 18B. The position of the linearly moving lock lever 40 shown in FIGS. 14 and 15 is the same as the position of the linearly moving lock lever 40 shown in FIG. 11.

When the linearly moving lock lever 40 is located at the position shown in FIGS. 12 and 13, etc., the projection 29A of the inertial lever 29 comes into contact with the first surface 44A of the linearly moving lock lever 40, whereby the inertial lever 29 is retained in an upward position. In the state shown in FIG. 13, if the inertial lever 29 rises, the inertial lever 29 comes into contact with the contact convex portion 12B and causes the pawl 12 to open the fork 11 so that the striker S1 can be released.

When the linearly moving lock lever 40 is displaced to the position shown in FIGS. 14 and 15, etc., the projection 29A of the inertial lever 29 comes into slide-contact with the second surface 44B of the linearly moving lock lever 40 and then comes into contact with the third surface 44C, whereby the inertial lever 29 is held inclined toward the vehicle exterior. In the state shown in FIG. 15, if the inertial lever 29 rises, the inertial lever 29 comes into contact with the inertial lever guide surface 90G, the inertial lever 29 separates from the contact convex portion 12B, and the pawl 12 continues to fix (retain) the fork 11.

The position of the inertial lever 29 shown in FIGS. 12 and 13 is an unlock position where the inertial lever 29 is capable of acting on the pawl 12. The position of the inertial lever 29 shown in FIGS. 14 and 15 is a lock position where the inertial lever 29 is incapable of acting on the pawl 12. In the position shown in FIGS. 11, 14, and 15, the third surface 44*C comes* into contact with the projection 29A and the linearly moving lock lever 40 retains the inertial lever 29 in the lock position. The position of the linearly moving lock lever 40 shown in FIGS. 11, 14, and 15 is a locked position.

In the position shown in FIGS. 12, and 13, etc., the third surface 44C separates (is spaced) from the projection 29A and the linearly moving lock lever 40 does not hold the inertial lever 29 in the lock position shown in FIGS. 14 and 15. The inertial lever 29 brings the projection 29A into contact with the first surface 44A due to the urging force of the torsion coil spring 29T. When an impact (shock or impulse) acts on the inertial lever 29 (e.g., due to a vehicle side collision), the inertial lever 29 causes the projection 29A to separate from the first surface 44A and is displaced to the lock position. The position of the linearly moving lock lever 40 shown in FIGS. 6, 12, 13, 18A, 18B, 19A and 19B is an unlocked position.

In the unlocked position shown in FIGS. 6, 12, 13, 18A, 18B, 19A and 19B, the linearly moving lock lever 40 causes the inertial lever 29 to stand upright and enables the fork 11 located in the latched position shown in FIG. 12 to be displaced to the unlatched position shown in FIG. 13. In the locked position shown in FIGS. 11, 14, and 15, the linearly moving lock lever 40 inclines the inertial lever 29 and disables (prevents) the fork 11 located in the latched position shown in FIG. 12 from being displaced to the unlatched position shown in FIG. 13.

When the linearly moving lock lever 40 is displaced to the unlocked position as shown in FIG. 6, the linearly moving lock lever 40 turns ON (connects) one of the contacts in the third switch SW3. When the linearly moving lock lever 40 is displaced to the locked position as shown in FIG. 11, the linearly moving lock lever 40 turns ON (connects) another contact in the third switch SW3. The ON/OFF signals of the two contacts in the third switch SW3 are used to control the locking and unlocking of the door and to ascertain the state of the door lock apparatus 1.

As shown in FIG. 2, the projecting end portions of the plurality of terminals T1 project into the connector 80C formed on the outer side of the second housing 80. On the other hand, as shown in FIG. 16, etc., the other (remaining) portions of the plurality of terminals T1 are housed in the housing chamber 7A.

As shown in FIG. 16, the terminals T1 are arranged in two rows such that three of the terminals T11 are located in an upper row and six of the terminals T12 are located in a lower row. The upper and lower rows extend at least substantially in parallel. The plurality of terminals T11 in the upper row include a first ground terminal T11E and second switch terminals T11A and T11B. The plurality of terminals T12 in the lower row include a second ground terminal T12E, a first switch terminal T12A, third switch terminals T12C and T12D, and motor terminals T12M and T12N.

As shown in FIG. 8, a first terminal holder 77, a second terminal holder 78, and a motor chamber 79M are formed in the first base wall 71 of the first housing 70.

The first terminal holder 77 is disposed at (on) an upper and frontward corner section of the first base wall 71. As shown in FIG. 16, in the first terminal holder 77, the first ground terminal THE and the second switch terminals T11A and T11B, which are a representative plurality of terminals T11 in the upper row, are arranged and held in one row in the front-rear direction.

As shown in FIG. 8, the second terminal holder 78 is disposed below the first terminal holder 77. As shown in FIG. 16, in the second terminal holder 78, the second ground terminal T12E, the first switch terminal T12A, the third switch terminals T12C and T12D, and the motor terminals T12M and T12N, which are a representative plurality of terminals T12 in the lower row, are also arranged and held in one row in the front-rear direction.

Although not shown in the Figures, a first end portion of the first ground terminal T11E is bent in a U-shape. A first end portion extending upward of the second ground terminal T12E is held in the U-shaped portion, whereby the first ground terminal THE and the second ground terminal T12E are electrically connected.

The second switch SW2 is disposed between the first terminal holder 77 in (on) the first base wall 71 and the upper side of the first peripheral edge section 73 of the first housing 70. The first ground terminal THE and the second switch terminals T11A and T11B are electrically connected to the second switch SW2.

The first switch SW1 is disposed below the rear end of the second terminal holder 78 in (on) the first base wall 71. The second ground terminal T12E and the first switch terminal T12A are electrically connected to the first switch SW1.

The third switch SW3 is disposed below the second switch SW2 in (on) the first base wall 71. The second ground terminal T12E and the third switch terminals T12C and T12D are electrically connected to the third switch SW3.

As shown in FIG. 8, the motor chamber 79M is formed as a recess below the front end of the second terminal holder 78 in the first base wall 71 and at a position adjacent to the front side of the first peripheral edge section 73. As shown in FIG. 16, the motor terminals T12M and T12N are electrically connected to the electric motor Ml retained in the motor chamber 79M.

The above-described representative door lock apparatus 1, which has such a configuration, can hold the door closed, open the door, and lock or unlock the door in the closed state with respect to the vehicle frame in response to different types of operations performed by an occupant of the vehicle.

<Functions and Effects>

In the door lock apparatus 1 of the above-described embodiment, when the fork 11 is located in the unlatched position as shown in FIG. 13, the fork following lever 59 is displaced (pivoted) to the blocking position shown in FIGS. 19A and 19B. The contacted portion 48 of the linearly moving lock lever 40, which is in its downward displaced state/position, contacts and is stopped (blocked) by the contact portion 58 of the fork following lever 59 that has been displaced (pivoted) to the blocking position. Therefore, upward displacement of the linearly moving lock lever 40 is inhibited (blocked). That is, when the fork following lever 59 has been displaced (pivoted) to the blocking position that corresponds to the unlatched position of the fork 11, the linearly moving lock lever 40 located in the unlocking position shown, e.g., in FIGS. 19A and 19B is inhibited (blocked) from being displaced (linearly shifted) to the locking position shown, e.g., in FIG. 11.

In this state, even if the user attempts to perform a locking operation by manually moving the interior lock knob H3, which would normally cause the I/S lock lever 35 to displace in the direction indicated by arrow Y1 shown in FIG. 19B, such displacement of the I/S lock lever 35 is prevented due to the linearly moving lock lever 40 and the fork following lever 59 being located/positioned in the state shown in FIGS. 19A and 19B. As a result, the user is prevented from performing the locking operation using the interior lock knob H3.

Similarly, even if the user attempts to perform a locking operation by inserting a key and turning the key cylinder H2, which would normally cause the O/S lock lever 30 to displace in the direction indicated by arrow Y2 shown in FIG. 17, such displacement of the O/S lock lever 30 also is prevented due to the linearly moving lock lever 40 and the fork following lever 59 being located/positioned in the state shown in FIGS. 19A and 19B. As a result, the user also is prevented from performing the locking operation using the key cylinder H2.

Thus, even when the interior lock knob H3 is operated to be locked with the fork 11 located in the unlatched position, rattling between the components tends not to accumulate because the displacement of the I/S lock lever 35 is prevented by two components, namely the linearly moving lock lever 40 and the fork following lever 59. Therefore, it is possible to improve the blocking rigidity (stiffness, resistance) with respect to the I/S lock lever 35. As a result, the user can feel/sense in a suitable manner that the locking operation on the interior lock knob H3 is being prevented (blocked).

Similarly, even when the key cylinder H2 is operated to be locked with the fork 11 located in the unlatched position, rattling between the components tends not to accumulate because the displacement of the O/S lock lever 30 is prevented by the two components. Therefore, it is possible to improve the blocking rigidity (stiffness, resistance) with respect to the O/S lock lever 30. As a result, the user can feel/sense in a suitable manner that the locking operation on the key cylinder H2 is being prevented (blocked).

In the door lock apparatus 1 of the above-described embodiment, the fork following lever 59 performs both the functions of interlocking (linking) with the fork 11 and contacting/stopping the linearly moving lock lever 40, but does not perform the function of disconnecting or connecting (turning OFF and ON) the first switch SW1. The adjuster SW lever 50 displaceable to the interior light (dome light) OFF position shown in FIGS. 16 and 18B and to the interior light (dome light) ON position shown in FIG. 19B, such that adjuster SW lever 50 performs the function of disconnecting or connecting (turning OFF and ON) the first switch SW1. Consequently, it is possible to optimize the shape and the disposition of the adjuster SW lever 50 as appropriate and to dispose the first switch SW1 at a position spaced apart from the fork 11, the linearly moving lock lever 40, and the fork following lever 59. Therefore, a reduction in thickness in the vehicle inward-outward direction can be achieved more easily than in known designs.

Therefore, the door lock apparatus 1 according to the above-described embodiment makes it possible to improve the blocking rigidity (stiffness, resistance) with respect to the I/S lock lever 35 and the O/S lock lever 30 when the fork 11 is located in the unlatched position. Therefore, it is possible to achieve a reduction in thickness in the vehicle inward-outward direction.

In the above-described door lock apparatus 1, as shown, e.g., in FIG. 6, the inertial lever 29, the linearly moving lock lever 40, the O/S lock lever 30, the I/S lock lever 35, the fork following lever 59, the adjuster SW lever 50, and the first switch SW1 are integrated (housed) in the housing chamber 7A rather than in the latch chamber 9A. Consequently, it is possible to reduce or minimize the size of the latch housing 9 and thereby achieve a further reduction in thickness in the vehicle inward-outward direction. In the housing chamber 7A, it is possible to optimize the shape and the disposition of the adjuster SW lever 50 and to increase design freedoms for the location (disposition) of the first switch SW1. Therefore, as shown in FIG. 16, the first switch SW1 may be easily disposed, e.g., near the connector 80C (shown in FIG. 2) such that it becomes possible to reduce the lengths of the second ground terminal T12E and the first switch terminal T12A that connect the first switch SW1 to the connector 80C.

Further, in the door lock apparatus 1, as shown in FIGS. 19A and 19B, when the contact portion 58 of the fork following lever 59 contacts and stops (blocks) the contacted portion 48 of the linearly moving lock lever 40, shifting (displacement) of the contact portion 58 relative to the contacted portion 48 is inhibited (prevented) because the convex portion 58A enters (is inserted into) the concave portion 48A. As a result, it is possible to reliably inhibit (prevent) the displacement of the linearly moving lock lever 40 to the locking position when the fork following lever 59 is located in the blocking position.

Although the present invention has been described above in line with a detailed embodiment, it is needless to say that the invention is not limited to the above-described detailed embodiment, and it may be appropriately modified in application without departing from the gist of the invention.

For example, in the above-described embodiment, the convex portion 58A is formed on the contact portion 58 and the concave portion 48A is formed in (on) the contacted portion 48. However, the present invention is not limited to this configuration. For example, a convex portion that projects toward a contact portion may be formed in a contacted portion. A concave portion, into which the convex portion can enter, may be formed in (on) the contact portion.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved vehicle door lock apparatuses and methods for manufacturing and operating the same.

Moreover, combinations of features and steps disclosed in the above detail description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A vehicle door lock apparatus comprising:

a housing fixed to a door, the door being openable and closable with respect to a vehicle frame, and the housing having an entry opening into which a striker fixed to the vehicle frame can enter;

a fork provided in the housing, the fork being pivotably displaceable to a latched position from an unlatched position and vice versa, the fork retaining the striker in the entry opening at the latched position, and allowing the striker to separate from the entry opening at the unlatched position;

a pawl provided in the housing, the pawl being configured to pivot so as to fix or release the fork;

a first lever provided in the housing, the first lever being pivotably displaceable in response to an opening operation being performed on a door handle, the opening operation causing the first lever to act on the pawl such that the pawl releases the fork;

a second lever provided in the housing, the second lever being displaceable to a locking position, where the second lever retains the first lever in a locked position where the first lever is unable to act on the pawl, and the second lever being displaceable to an unlocking position where the second lever does not retain the first lever in the locked position, wherein, in the unlocking position, the second lever enables displacement of the fork located in the latched position to the unlatched position and, in the locking position, the second lever disables displacement of the fork located in the latched position to the unlatched position;

a third lever provided in the housing, the third lever being configured to pivotably displace the second lever from the locking position to the unlocking position response to an unlocking operation being performed on a lock operator and the third lever being configured to displace the second lever from the unlocking position to the locking position in response to a locking operation being performed on the lock operator;

a fourth lever provided in the housing, the fourth lever being linked with the fork such that the fourth lever is displaceable to an unblocking position when the fork displaces to the latched position and the fourth lever is displaceable to a blocking position when the fork displaces to the unlatched position, wherein in the unblocking position, the fourth lever is spaced apart from the second lever, and, in the blocking position, the fourth lever contacts the second lever located in the unlocking position and blocks the second lever from being displaced to the locking position; and a fifth lever provided in the housing and linked with the fourth lever, the fifth lever being configured to detect whether the fork is located in the latched position or the unlatched position via engagement or disengagement of the fifth lever with a switch, to turn ON and turn OFF the switch.

2. The vehicle door lock apparatus according to claim 1, wherein:

the housing includes a latch housing having a latch chamber formed therein, and an actuating housing mounted on the latch housing, a housing chamber being formed in the actuating housing, the entry opening is formed in the latch housing, the fork and the pawl are housed in the latch chamber, a connector is connected to the switch and is provided in the actuating housing, and the first lever, the second lever, the third lever, the fourth lever, the fifth lever, and the switch are housed in the housing chamber.

3. The vehicle door lock apparatus according to claim 2, wherein:

the fourth lever has a contact portion configured to contact and block the second lever when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

4. The vehicle door lock apparatus according to claim 1, wherein:

the fourth lever has a contact portion configured to contact and block the second lever when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

5. A vehicle comprising:

a vehicle frame;

a striker affixed to the vehicle frame;

a vehicle door that is openable and closable with respect to the vehicle frame;

a door handle movably disposed on the vehicle door;

a housing affixed to the vehicle door and having an entry opening configured to receive the striker;

a fork provided in the housing, the fork being pivotably displaceable to a latched position from an unlatched position and vice versa, the fork retaining the striker in the entry opening at the latched position, and the fork allowing the striker to separate from the entry opening at the unlatched position;

a pawl provided in the housing, the pawl being configured to pivot so as to fix or release the fork;

a first lever provided in the housing, the first lever being pivotably displaceable in response to an opening operation being performed on the door handle, the opening operation causing the first lever to act on the pawl such that the pawl releases the fork;

a second lever provided in the housing, the second lever being displaceable to a locking position, where the second lever retains the first lever in a locked position where the first lever is unable to act on the pawl, and the second lever being displaceable to an unlocking position where the second lever does not retain the first lever in the locked position, wherein, in the unlocking position, the second lever enables displacement of the fork located in the latched position to the unlatched position and, in the locking position, the second lever disables displacement of the fork located in the latched position to the unlatched position;

a third lever provided in the housing, the third lever being configured to pivotably displace the second lever from the locking position to the unlocking position in response to an unlocking operation being performed on a lock operator operably coupled to the third lever and the third lever being configured to displace the second lever from the unlocking position to the locking position in response to a locking operation being performed on the lock operator;

a fourth lever provided in the housing, the fourth lever being linked with the fork such that the fourth lever is displaceable to an unblocking position when the fork displaces to the latched position and the fourth lever is displaceable to a blocking position when the fork displaces to the unlatched position, wherein in the unblocking position, the fourth lever is spaced apart from the second lever, and, in the blocking position, the fourth lever contacts the second lever located in the unlocking position and blocks the second lever from being displaced to the locking position;

a switch located in the housing; and a fifth lever provided in the housing and linked with the fourth lever, the fifth lever being configured to turn ON the switch via engagement or disengagement of the fifth lever with the switch when the fork is located in the latched position and the fifth lever being configured to turn OFF the switch via engagement or disengagement of the fifth lever with the switch when the fork is located in the unlatched position.

6. The vehicle according to claim 5, wherein:

the housing includes a latch housing having a latch chamber formed therein, and an actuating housing mounted on the latch housing, a housing chamber being formed in the actuating housing, the entry opening is formed in the latch housing, the fork and the pawl are housed in the latch chamber, a connector is connected to the switch and is provided in the actuating housing, and the first lever, the second lever, the third lever, the fourth lever, the fifth lever, and the switch are housed in the housing chamber.

7. The vehicle according to claim 6, wherein:

the fourth lever has a contact portion configured to contact and block the second lever from being displaced to the locking position when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

8. The vehicle according to claim 5, wherein:

the fourth lever has a contact portion configured to contact and block the second lever from being displaced to the locking position when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

9. An apparatus comprising:

a housing configured to be affixed to a vehicle door, the housing having an entry opening configured to receive a striker affixed to a vehicle frame;

a fork provided in the housing, the fork being pivotably displaceable to a latched position from an unlatched position and vice versa, the fork retaining the striker in the entry opening at the latched position, and allowing the striker to separate from the entry opening at the unlatched position;

a pawl provided in the housing, the pawl being configured to pivot so as to fix or release the fork;

a first lever provided in the housing, the first lever being displaceable in response to an opening operation being performed on a vehicle door handle, the opening operation causing the first lever to act on the pawl such that the pawl releases the fork;

a second lever provided in the housing, the second lever being displaceable to a locking position, where the second lever retains the first lever in a locked position where the first lever is unable to act on the pawl, and the second lever being displaceable to an unlocking position where the second lever does not retain the first lever in the locked position, wherein, in the unlocking position, the second lever enables displacement of the fork located in the latched position to the unlatched position and, in the locking position, the second lever disables displacement of the fork located in the latched position to the unlatched position;

a third lever provided in the housing, the third lever being configured to pivotably displace the second lever from the locking position to the unlocking position in response to an unlocking operation being performed on a lock operator and the third lever being configured to displace the second lever from the unlocking position to the locking position in response to a locking operation being performed on the lock operator;

a fourth lever provided in the housing, the fourth lever being linked with the fork such that the fourth lever is displaceable to an unblocking position when the fork displaces to the latched position and the fourth lever is displaceable to a blocking position when the fork displaces to the unlatched position, wherein in the unblocking position, the fourth lever is spaced apart from the second lever, and, in the blocking position, the fourth lever contacts the second lever located in the unlocking position and blocks the second lever from being displaced to the locking position;

a switch located in the housing; and a fifth lever provided in the housing and linked with the fork via the fourth lever, the fifth lever being configured to turn ON the switch via engagement or disengagement of the fifth lever with the switch when the fork is located in the latched position and the fifth lever being configured to turn OFF the switch via engagement or disengagement of the fifth lever with the switch when the fork is located in the unlatched position.

10. The apparatus according to claim 9, wherein:

the housing includes a latch housing having a latch chamber formed therein, and an actuating housing mounted on the latch housing, a housing chamber being formed in the actuating housing, the entry opening is formed in the latch housing, the fork and the pawl are housed in the latch chamber, a connector is connected to the switch and is provided in the actuating housing, and the first lever, the second lever, the third lever, the fourth lever, the fifth lever, and the switch are housed in the housing chamber.

11. The apparatus according to claim 10, wherein:

the fourth lever has a contact portion configured to contact and block the second lever from being displaced to the locking position when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

12. The apparatus according to claim 9, wherein:

the fourth lever has a contact portion configured to contact and block the second lever from being displaced to the locking position when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

13. The apparatus according to claim 9, further comprising:

an outside open lever pivotably disposed within the housing;

wherein the first lever is pivotably supported on the outside open lever, the vehicle door handle is an outside door handle, and the outside open lever is coupled to a transmission rod that is configured to be coupled to the outside door handle.

14. The apparatus according to claim 13, wherein the lock operator is a key cylinder or a door knob.

15. The apparatus according to claim 14, wherein the switch outputs an ON/OFF signal for controlling a dome light within a passenger cabin.

16. The apparatus according to claim 15, further comprising:

an inside open lever pivotably disposed within the housing;

wherein the inside open lever is coupled to a transmission cable configured to be coupled to an inside vehicle door handle and the inside open lever is configured to pivot the outside open lever to cause the outside open lever to pivot the first lever and thereby cause the pawl to release the fork.

17. The apparatus according to claim 16, wherein:

the housing includes a latch housing having a latch chamber formed therein, and an actuating housing mounted on the latch housing, a housing chamber being formed in the actuating housing, the entry opening is formed in the latch housing, the fork and the pawl are housed in the latch chamber, a connector is connected to the switch and is provided in the actuating housing, and the first lever, the second lever, the third lever, the fourth lever, the fifth lever, the outside open lever, the inside open lever, the key cylinder and the switch are housed in the housing chamber.

18. The apparatus according to claim 17, wherein:

the fourth lever has a contact portion configured to contact and block the second lever from being displaced to the locking position when the fourth lever is located in the blocking position, the second lever has a contacted portion configured to be contacted and blocked by the contact portion, on one of the contact portion and the contacted portion, a convex portion projecting toward the other of the contact portion and the contacted portion is formed, and in the other of the contact portion and the contacted portion, a concave portion, into which the convex portion is configured to enter, is formed.

* * * * *